US011036157B2

(12) United States Patent
Takagi

(10) Patent No.: US 11,036,157 B2
(45) Date of Patent: Jun. 15, 2021

(54) IMAGE FORMING APPARATUS INCORPORATING WRITING DEVICE

(71) Applicant: Hiroaki Takagi, Kanagawa (JP)

(72) Inventor: Hiroaki Takagi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/695,880

(22) Filed: Nov. 26, 2019

(65) Prior Publication Data

US 2020/0174395 A1 Jun. 4, 2020

(30) Foreign Application Priority Data

Nov. 29, 2018 (JP) ..... JP2018-223222
Jul. 11, 2019 (JP) ..... JP2019-129316

(51) Int. Cl.
*G03G 15/04* (2006.01)

(52) U.S. Cl.
CPC ..... *G03G 15/04036* (2013.01)

(58) Field of Classification Search
CPC ..... G03G 15/04036
See application file for complete search history.

(56) References Cited

U.S. PATENT DOCUMENTS 5,764,269 A 6/1998 Takeshita et al.
9,367,018 B1 6/2016 Ichikawa et al.
2004/0240880 A1* 12/2004 Ono ..... G03G 15/04072 396/612
2010/0061777 A1* 3/2010 Matsumoto ..... G03G 15/1695 399/316
2010/0232819 A1 9/2010 Kudo et al.
2010/0239282 A1 9/2010 Ashikawa et al.
2011/0110691 A1 5/2011 Hirose et al.
2011/0150530 A1* 6/2011 Takahashi ..... G03G 15/5008 399/167
2011/0206423 A1* 8/2011 Sugita ..... G03G 15/0131 399/308
2011/0222882 A1* 9/2011 Sugiyama ..... G03G 15/0131 399/49
2012/0190489 A1 7/2012 Takagi
2013/0071150 A1 3/2013 Takagi
2014/0086605 A1* 3/2014 Yoshida ..... G03G 15/16 399/45
2015/0240879 A1 8/2015 Takagi et al.
2016/0062300 A1 3/2016 Takagi et al.
2016/0223977 A1 8/2016 Yamazaki et al.
2016/0238981 A1 8/2016 Suido et al.
(Continued)

FOREIGN PATENT DOCUMENTS

JP 7-325238 12/1995
JP 2005-249933 9/2005

*Primary Examiner* — Sevan A Aydin
(74) *Attorney, Agent, or Firm* — Harness, Dickey & Pierce, P.L.C.

(57) ABSTRACT

An image forming apparatus includes an image bearer, a writing device, a partition, and a plurality of side members. The image bearer is configured to bear an image. The writing device is configured to write the image on the image bearer. The partition is disposed between the image bearer and the writing device. The plurality of side members is disposed facing and spaced apart from each other at an interval in an axial direction of the image bearer. The writing device is fixed to the plurality of side members and is spaced apart from the partition.

12 Claims, 21 Drawing Sheets

(56) References Cited

U.S. PATENT DOCUMENTS

| | | | |
|---|---|---|---|
| 2017/0010576 | A1 | 1/2017 | Takagi et al. |
| 2017/0357200 | A1 | 12/2017 | Takagi et al. |
| 2018/0074455 | A1 | 3/2018 | Takagi |

* cited by examiner

IMAGE FORMING APPARATUS INCORPORATING WRITING DEVICE

CROSS-REFERENCE TO RELATED APPLICATIONS

This patent application is based on and claims priority pursuant to 35 U.S.C. § 119(a) to Japanese Patent Application Nos. 2018-223222, filed on Nov. 29, 2018, and 2019-129316, filed on Jul. 11, 2019, in the Japan Patent Office, the entire disclosure of each of which is hereby incorporated by reference herein.

BACKGROUND

Technical Field

This disclosure relates to an image forming apparatus including a writing device.

Discussion of the Background Art

Various types of image forming apparatuses are known to include a latent image bearer, a writing device to write a latent image onto the latent image bearer, and a partition to divide the latent image bearer and the writing device.

SUMMARY

At least one aspect of this disclosure provides an image forming apparatus including an image bearer, a writing device, a partition, and a plurality of side members. The image bearer is configured to bear an image. The writing device is configured to write the image on the image bearer. The partition is disposed between the image bearer and the writing device. The plurality of side members is disposed facing and spaced apart from each other at an interval in an axial direction of the image bearer. The writing device is fixed to the plurality of side members and is spaced apart from the partition.

BRIEF DESCRIPTION OF THE SEVERAL VIEWS OF THE DRAWINGS

An exemplary embodiment of this disclosure will be described in detail based on the following figured, wherein.

DETAILED DESCRIPTION

Figure 1:
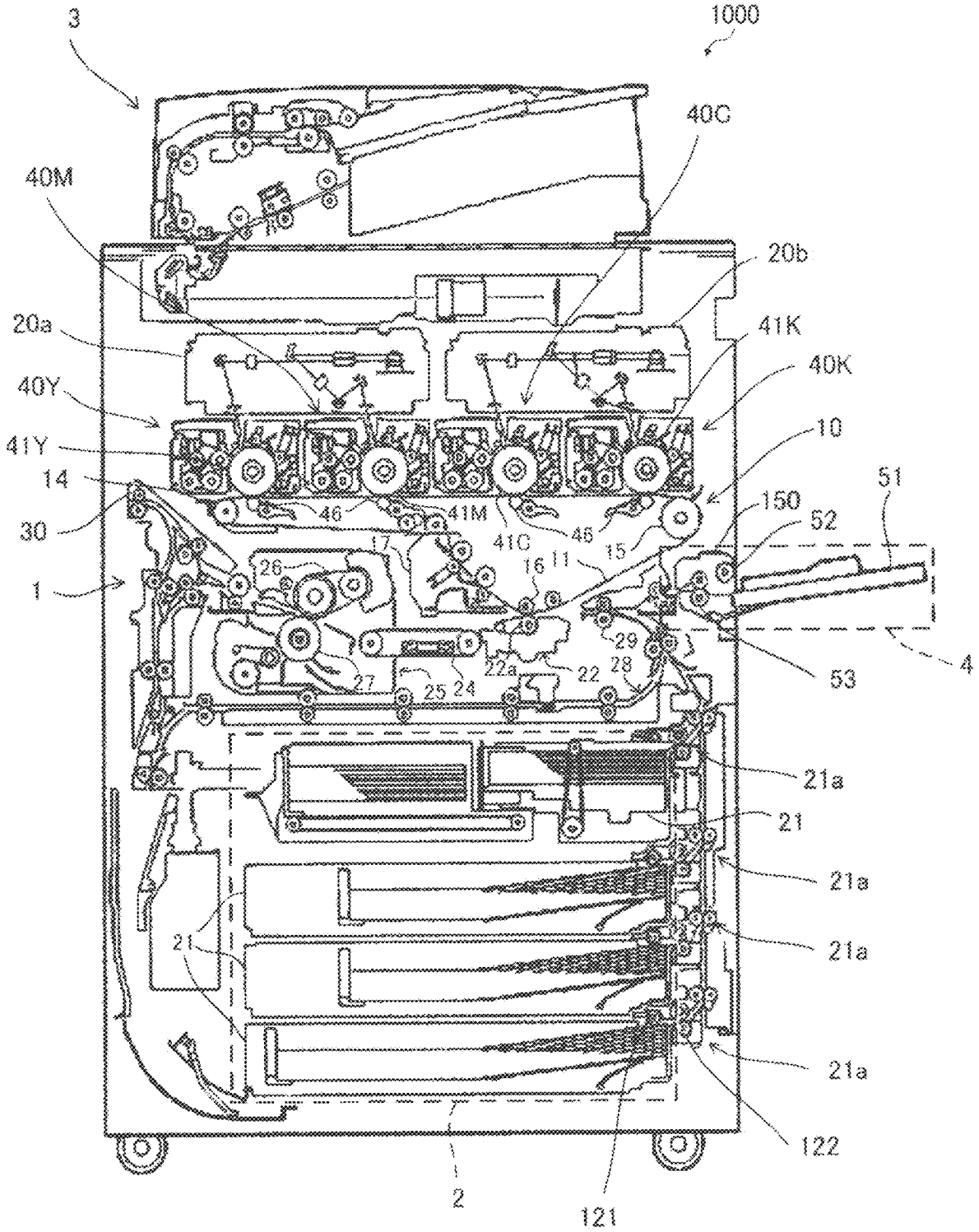
FIG. 1 is a schematic diagram illustrating an image forming apparatus according to an embodiment of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

Hereinafter, a detailed description is given of an embodiment of this disclosure with reference to the drawings.

It is to be noted that elements (for example, mechanical parts and components) having the same functions and shapes are denoted by the same reference numerals throughout the specification and redundant descriptions are omitted.

A description is given hereinafter of embodiments where this disclosure is applied to an image forming apparatus 1000, for example a copier in the following embodiments.

First, a description is given of the outline of the image forming apparatus 1000, with reference to FIG. 1.

The image forming apparatus 1000 has the function as what is called a digital color copier that digitizes image information obtained by scanning and reading an original document, and uses the image information to form an image. Further, the image forming apparatus 1000, that is, the copier, also has the function of a facsimile machine that sends/receives image data of an original document to/from a remote place, and the function of what is called a printer that prints, on a recording sheet, image information handled by a computer.

It is to be noted in the following examples that: the term "image forming apparatus" indicates an apparatus in which an image is formed on a recording medium such as paper, OHP (overhead projector) transparencies, OHP film sheet, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., an OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Further, it is to be noted in the following examples that: the term "sheet conveying direction" indicates a direction in which a recording medium travels from an upstream side of a sheet conveyance passage to a downstream side thereof; the term "width direction" indicates a direction basically perpendicular to the sheet conveyance direction.

In FIG. 1, the image forming apparatus 1000 forms an image on a recording sheet by performing an intermediate transfer operation using an intermediate transfer belt 11, and is a tandem-type electrophotographic apparatus that forms a toner image of each color with a corresponding dedicated process cartridge. A multistage sheet feeding device 2 is provided in the lowermost part of the image forming apparatus 1000 in the vertical direction. Moreover, an image forming device 1 is provided above the sheet feeding device 2, and a scanner 3 is provided above the image forming device 1. At each stage, the sheet feeding device 2 includes a sheet feed tray 21 and a sheet feeding unit 21*a*. The sheet feed tray 21 contains a sheet bundle including recording sheets such as plain paper, OHP film sheet, and traced drawings, as recording sheets. The sheet feeding unit 21*a* feeds a recording sheet of the sheet bundle contained in the sheet feed tray 21. The sheet feeding unit 21*a* includes a pickup roller 121 and a sheet separation and conveyance unit 122. The pickup roller 121 picks up and feeds a recording sheet from the sheet feed tray 21. The sheet separation and conveyance unit 122 separates and feeds the recording sheet fed by the pickup roller 121.

A transfer device 10 is arranged at the substantially center of the image forming device 1. In the transfer device 10, multiple rollers are arranged inside an endless loop of the intermediate transfer belt 11 so that the intermediate transfer belt 11 is stretched around the multiple rollers.

The intermediate transfer belt 11 rotates in a clockwise direction in FIG. 1. In other words, the surface of the intermediate transfer belt 11 moves in the clockwise direction in FIG. 1.

Four process cartridges 40Y, 40M, 40C, and 40K for forming toner images in yellow, magenta, cyan, and black are arranged above the intermediate transfer belt 11, along a direction of movement of the surface of the intermediate transfer belt 11. Since the configurations of the four process cartridges 40Y, 40M, 40C, and 40K, each functioning as an image forming device, are identical to each other except for the color of toner, the suffixes "Y", "M", "C", and "K" indicating respective colors are omitted below as appropriate.

Moreover, two optical writing units are provided above the four process cartridges 40Y, 40M, 40C, and 40K. The two optical writing units are a first writing unit 20*a* and a second writing unit 20*b*, each functioning as a latent image writing unit, or simply, a writing unit.

The process cartridge 40 (i.e., the process cartridges 40Y, 40M, 40C, and 40K) includes a drum-shaped photoconductor 41 (i.e., photoconductors 41Y, 41M, 41C, and 41K) that functions as a latent image bear, or simply, an image bearer. Each photoconductor 41 is rotatable in a counterclockwise direction in FIG. 2. A charging device, a developing device, a photoconductor cleaning device, and a lubricant application device are provided around the photoconductor 41.

In FIG. 1, the transfer device 10 includes the intermediate transfer belt 11, a belt cleaning device 17, and four primary transfer rollers 46 (i.e., primary transfer rollers 46Y, 46M, 46C, and 46K).

The intermediate transfer belt 11 is stretched (tensioned) by a plurality of rollers including a tension roller 14, a drive roller 15, and a secondary transfer counter roller 16. The intermediate transfer belt 11 is endlessly moved in the clockwise direction in FIG. 1 along with rotation of the drive roller 15 driven by a belt drive motor.

The four primary transfer rollers 46 (i.e., the primary transfer rollers 46Y, 46M, 46C, and 46K) are arranged to respectively contact an inner circumferential surface side of the intermediate transfer belt 11. A primary transfer bias is applied to the primary transfer rollers 46 by a power supply. Moreover, the intermediate transfer belt 11 is pressed by the primary transfer rollers 46 from the inner circumferential surface toward the photoconductors 41 to form respective primary transfer nip regions. A primary transfer electric field is formed between the photoconductor 41 and the primary transfer roller 46 in each primary transfer nip region due to the influence of the primary transfer bias. The toner image formed on the surface of the photoconductor 41 is primarily transferred onto the intermediate transfer belt 11 under the influence of the primary transfer electric field and the nip pressure.

Moreover, the transfer device 10 includes a secondary transfer roller 22. The secondary transfer roller 22 is disposed below the intermediate transfer belt 11 and functions as a secondary transfer body. The secondary transfer roller 22 includes a secondary transfer roller 22*a* that contacts and presses the secondary transfer counter roller 16 via the intermediate transfer belt 11. Then, the secondary transfer roller 22*a* secondarily transfers the toner images on the intermediate transfer belt 11 collectively onto a recording sheet conveyed to the secondary transfer nip region formed between the secondary transfer roller 22*a* and the intermediate transfer belt 11.

The belt cleaning device 17 is disposed downstream from the secondary transfer counter roller 16 in the direction of movement of the surface of the intermediate transfer belt 11. The belt cleaning device 17 removes residual toner remaining on the surface of the intermediate transfer belt 11 after the images have been transferred onto the recording sheet. The belt cleaning device 17 further includes a lubricant applying mechanism. The lubricant applying mechanism applies lubricant to the surface of the intermediate transfer belt 11.

A fixing device 25 is provided downstream from the secondary transfer roller 22*a* in a sheet conveyance direction. The fixing device 25 fixes the toner image formed on the recording sheet, to the surface of the recording sheet. A fixing pressure roller 27 is pressed against an endless fixing belt 26. The recording sheet on which the transferred image is formed is conveyed to the fixing device 25 by an endless conveyance belt 24 bridged across a pair of rollers.

Moreover, a sheet reversing device 28 is provided below the secondary transfer roller 22*a*. The sheet reversing device 28 reverses a recording sheet upon formation of an image on both the front and back sides of the recording sheet.

A bypass sheet feeding device 4 is disposed on the right side of the image forming device 1 in FIG. 1. The bypass sheet feeding device 4 includes a bypass tray 51 and a bypass sheet feeding device 150. The bypass tray 51 loads a recording sheet to be fed by a bypass sheet feeding operation. The bypass sheet feeding device 150 feeds the recording sheet loaded on the bypass tray 51. The bypass sheet feeding device 150 includes a bypass pickup roller 52 and a bypass separation and conveyance unit 53. The bypass pickup roller 52 picks up and feeds a recording sheet from the bypass tray 51. The bypass pickup roller 52 functions as a contact and separation member to contact and separate with respect to the recording sheet. The bypass separation and conveyance unit 53 separates and conveys the recording sheet fed from the bypass tray 51.

When a color original document is copied with the image forming apparatus 1000 including the above-described configurations, the scanner 3 reads an image of the color original document placed on an exposure glass. Moreover, the intermediate transfer belt 11 is rotated to form a toner image on each photoconductor 41 by known image forming processes employed to the image forming apparatus 1000. Then, the toner images formed on the photoconductors 41Y, 41M, 41C, and 41K are sequentially overlaid to be primarily transferred onto the intermediate transfer belt 11. Accordingly, a four-color composite toner image is formed on the intermediate transfer belt 11.

In synchronization with the image forming operations of the four single-color toner images being transferred onto the intermediate transfer belt 11, the sheet feeding unit 21*a* separates and feeds recording sheets, one by one, from a selected one of the sheet feed trays 21 of the sheet feeding device 2, and the separated recording sheet is conveyed toward a pair of registration rollers 29.

Instead of feeding recording sheets from the sheet feed tray 21, a recording sheet may be fed and conveyed by the bypass tray 51. In this case, the recording sheets on the bypass tray 51 are separated and fed one by one by the bypass sheet feeding device 150, toward the pair of registration rollers 29.

Then, the separated recording sheet is conveyed to the pair of registration rollers 29 to contact a nip region of the pair of registration rollers 29. By causing the recording sheet to contact the nip region of the pair of registration rollers 29, the conveyance of the recording sheet is temporarily stopped, and the recording sheet is being held for standby. The pair of registration rollers 29 resumes the rotation at a proper timing in such a manner as to set the positional relationship between the four-color toner image overlaid on the intermediate transfer belt 11 and a leading end of the recording sheet, to a given position. As the pair of registration rollers 29 starts rotating, the standby recording sheet is conveyed again. Consequently, the secondary transfer roller 22*a* secondarily transfers the four-color composite toner image on the intermediate transfer belt 11, to the given position of the recording sheet. Thus, a full color toner image is formed on the recording sheet.

Thus, the recording sheet with the full color toner image is conveyed to the fixing device 25 that is disposed downstream from the secondary transfer roller 22*a* along the sheet conveyance passage. The fixing device 25 fixes the full color toner image that has been secondarily transferred by the secondary transfer roller 22*a*, to the recording sheet. The recording sheet with the fixed full color image is ejected by a pair of sheet ejection rollers 30 to the outside of the image forming apparatus 1000.

In a case in which a duplex printing mode is selected to form images on both sides of a recording sheet, when the recording sheet having the full color toner image fixed on the first face is ejected from the fixing device 25, the recording sheet is conveyed to the sheet reversing device 28 instead of being conveyed to the pair of sheet ejection rollers 30. After the front and back sides of the recording sheet are reversed by the sheet reversing device 28, the recording sheet is conveyed again to the pair of registration rollers 29. The recording sheet passes through the secondary transfer nip region formed between the secondary transfer roller 22*a* and the intermediate transfer belt 11 and then through the fixing device 25, so that a full color image is formed on a second face (the back side) of the recording sheet P.

Next, a description is given of the configuration and operations of the first writing unit 20*a* and the second writing unit 20*b*.

The first writing unit 20*a* writes a magenta (M) color latent image on the photoconductor 41M and a yellow (Y) color image on the photoconductor 41Y. The second writing unit 20*b* writes a black (K) color image on the photoconductor 41K and a cyan (C) color image on the photoconductor 41C. The first writing unit 20*a* and the second writing unit 20*b* have the basic configuration identical to each other. Therefore, for convenience, the configuration and operations of one writing unit, that is, the second writing unit 20*b*, are explained in the following description.

It is to be noted that the suffixes "Y", "M", "C", and "K" indicating respective colors are omitted below as appropriate.

Figure 2:
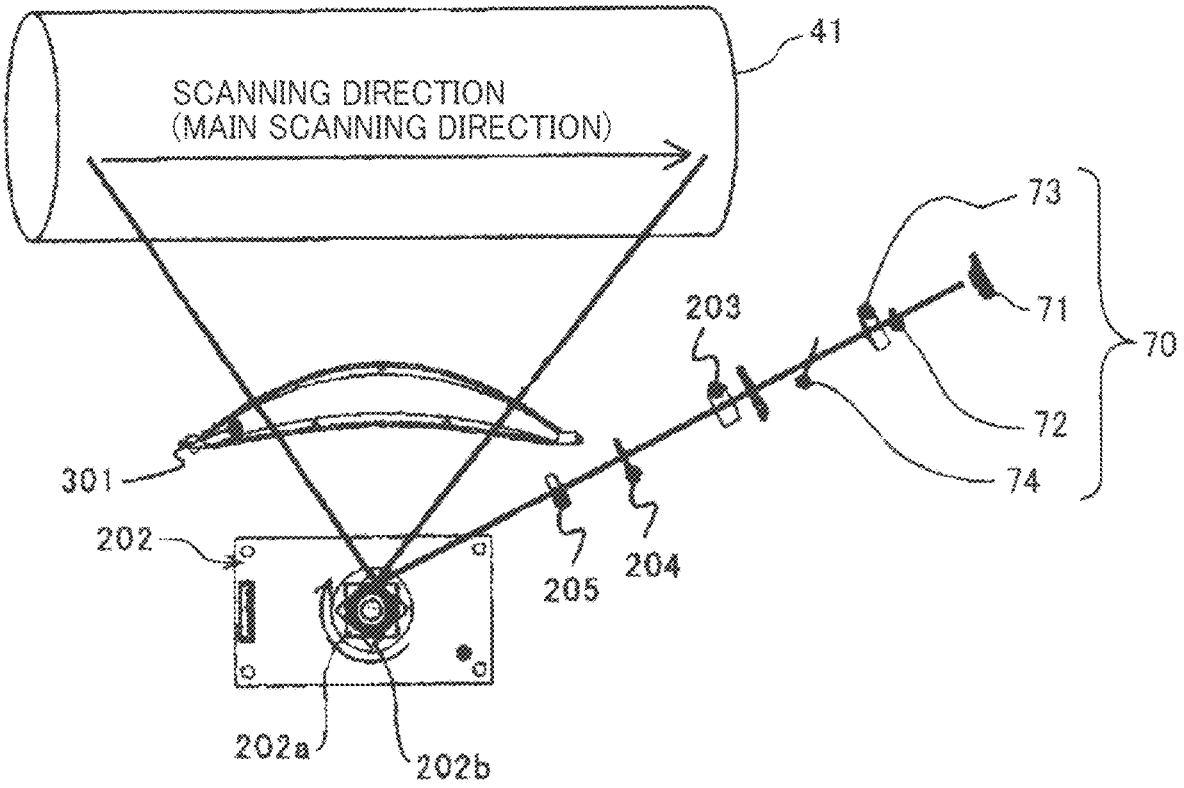
FIG. 2 is a schematic diagram illustrating a layout of an incident optical system of a second writing unit.

FIG. 2 is a schematic diagram illustrating a layout of an incident light optical system of the second writing unit 20*b*.

A light source unit 70 that functions as a light source device includes a light source 71 and a ¼ (quarter) wavelength plate 72. The light source 71 emits laser light with linearly polarized light. The ¼ wavelength plate 72 converts the laser light emitted from the light source 71 into circularly polarized light. The light source unit 70 further includes a collimator lens 73 and an aperture 74. The collimator lens 73 converts the laser light converted into circularly polarized light by the ¼ wavelength plate 72, into parallel light. The aperture 74 cuts out the laser light parallelized by the collimator lens 73. The laser light emitted from the light source unit 70 is incident on a deflector 202 that functions as a light deflector, via an incident optical system.

The incident optical system includes a deflecting beam splitter (PBS) 203, a ¼ wavelength plate 204, and a cylindrical lens 205.

The PBS 203 divides the laser light emitted from the light source unit 70, into two in the sub-scanning direction (the front-rear direction in the drawing sheet of FIG. 2).

The ¼ wavelength plate 204 converts the polarization characteristics of the laser beams L1 and L2 (see FIG. 3) divided into two by the PBS 203, from linear polarization to circular polarization.

The cylindrical lens 205 performs image formation of the laser lights L1 and L2 converted to circular polarization, on the mirror faces of the rotary polygon mirrors 202*a* and 202*b*, respectively, provided in the deflector 202. The cylindrical lens 205 has a light focusing function of the laser light converted into circular polarization, in the sub-scanning direction alone.

The laser beams L1 and L2 formed in a given laser profile by the above-described incident optical system are imaged on the mirror faces of the rotary polygon mirrors 202*a* and 202*b* of the deflector 202, respectively. The deflector 202 stably drives the rotary polygon mirrors 202*a* and 202*b* integrally as a single unit, at a given rotational speed, about a rotary axis parallel to the sub-scanning direction. As described above, as the laser light is incident onto the mirror faces of the rotating polygon mirrors 202*a* and 202*b* in rotation, the laser light is scanned in the main scanning direction, as illustrated in FIG. 2.

Figure 3:
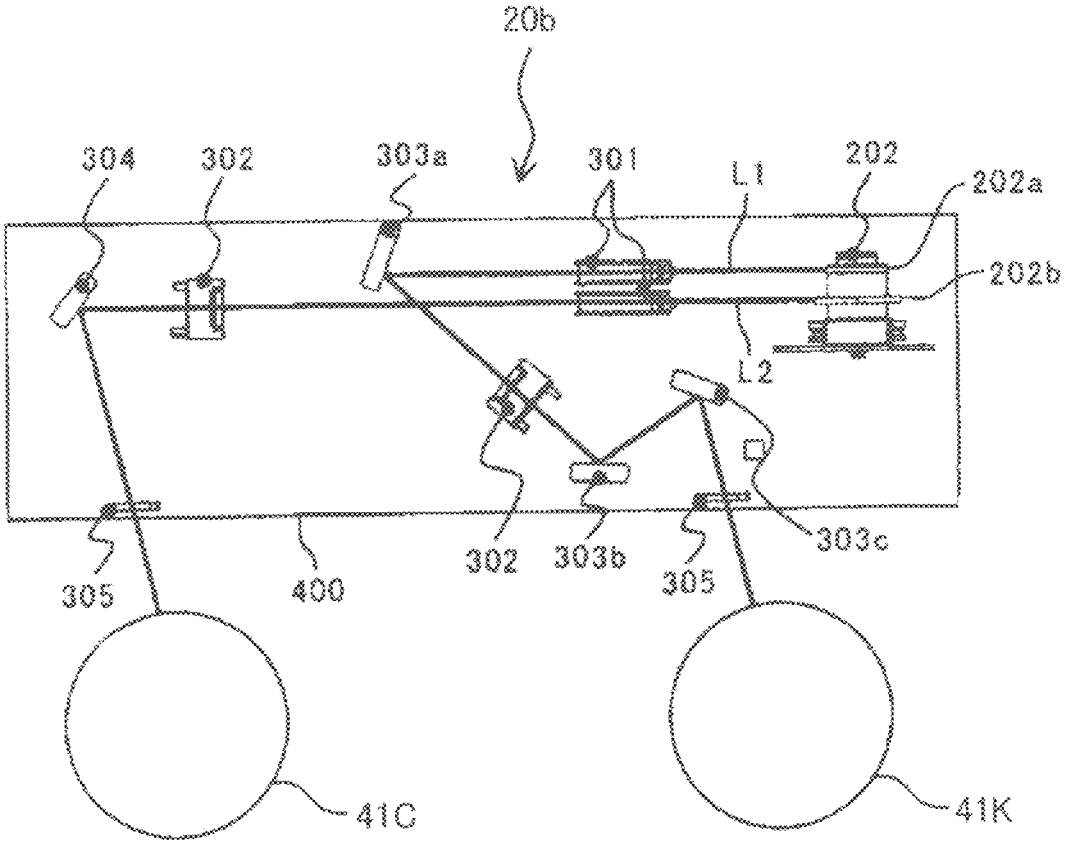
FIG. 3 is a schematic diagram illustrating a layout of a scanning optical system of a writing unit.

FIG. 3 is a schematic diagram illustrating a layout of a scanning optical system of the second writing unit 20*b*. It is to be noted that, as described above, the first writing unit 20*a* and the second writing unit 20*b* have the basic configuration identical to each other, and it is to be understood that FIG. 3 also explains the layout of the scanning optical system of the first writing unit 20*a*.

Of the laser lights scanned by the deflector 202, the laser light L1 (in other words, the laser light scanned on the mirror face of the upper rotary polygon mirror 202*a*) passes through the scanning lens 301 and the long lens 302, and then penetrates (passes through) a dust-proof glass 305. Then, the laser light L1 is scanned on the surface of the photoconductor 41K at a constant speed. On this optical path, a first mirror 303*a*, a second mirror 303*b*, and a third mirror 303*c* are disposed to reflect the laser light L1.

On the other hand, the laser light L2 (in other words, the laser light scanned on the mirror face of the lower rotary polygon mirror 202*b*) passes through the scanning lens 301 and the long lens 302, and penetrates (passes through) the dust-proof glass 305. Then, the laser light L2 is scanned on the surface of the photoconductor 41C at a constant speed. On this optical path, a mirror 304 is disposed to reflect the laser light L2. These parts and components of the second writing unit 20*b* are encased in a casing 400.

Figure 4:
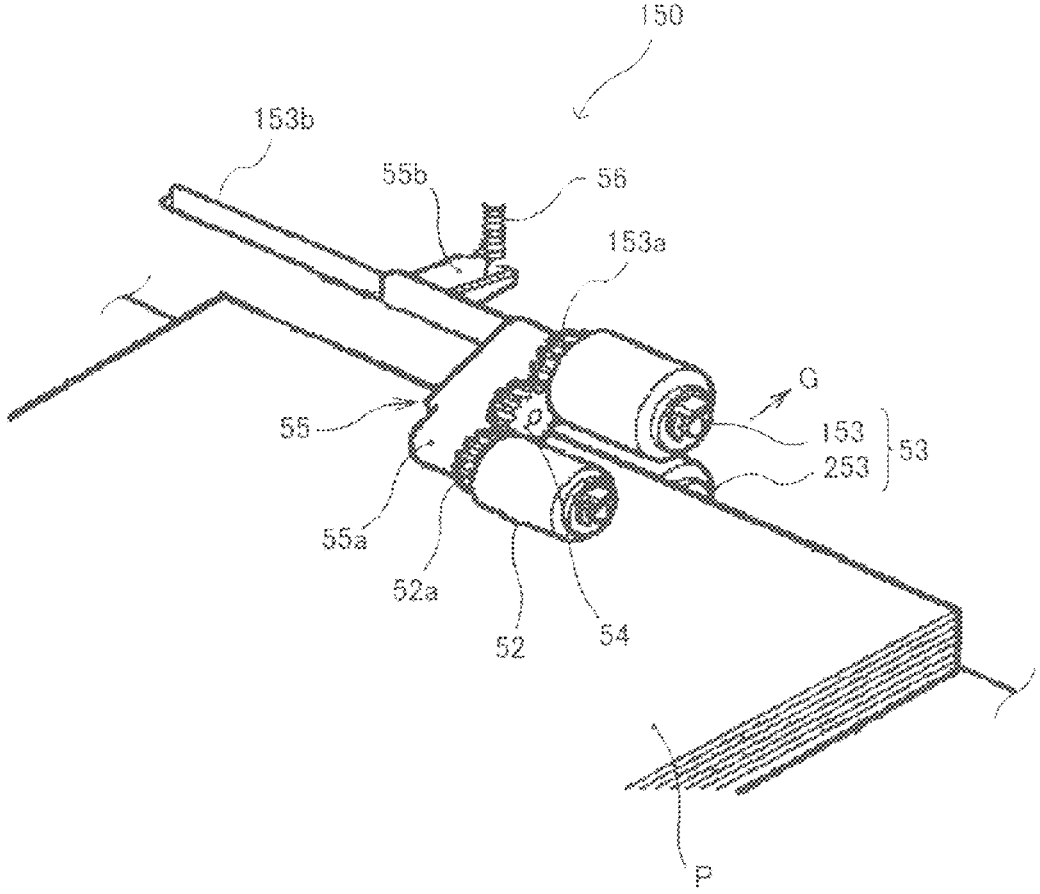
FIG. 4 is a perspective view illustrating a schematic configuration of a main part of a bypass sheet feeding device.

FIG. 4 is a perspective view illustrating a schematic configuration of the main part of the bypass sheet feeding device 150.

The bypass sheet feeding device 150 includes a bypass pickup roller 52 and a bypass separation and conveyance unit 53. The bypass pickup roller 52 contacts an uppermost recording sheet placed on top of the sheet bundle loaded on the bypass tray 51. The bypass separation and conveyance unit 53 includes a bypass feed roller 153 and a bypass reverse roller 253, to separate the recording sheet or sheets conveyed by the bypass pickup roller 52, one by one to a single sheet, and convey the separated single sheet.

The bypass feed roller 153 includes a rotary shaft 153*b* that is coupled to a drive motor. Further, an arm 55 is rotatably attached to the rotary shaft 153*b* of the bypass feed roller 153. The arm 55 is provided with a roller mounting portion 55*a* and a spring mounting portion 55*b*.

An idler gear 54 and the bypass pickup roller 52 are rotatably attached to the roller mounting portion 55*a*. The idler gear 54 meshes with a gear 153*a* mounted on the bypass feed roller 153 and a gear 52*a* mounted on the bypass pickup roller 52. Thus, a rotation driving force of the drive motor is transmitted from the gear 153*a* mounted on the bypass feed roller 153 to a bypass pickup roller 63 via the idler gear 54, so as to rotate the bypass pickup roller 52.

A spring 56 is attached to the spring mounting portion 55*b* to bias the spring mounting portion 55*b* in an upward direction in FIG. 4. According to this configuration, the arm 55 is biased by the spring 56 in a counterclockwise direction in FIG. 4, and the bypass pickup roller 52 is biased toward a direction to contact an uppermost recording sheet P of the sheet bundle.

Figure 5A:
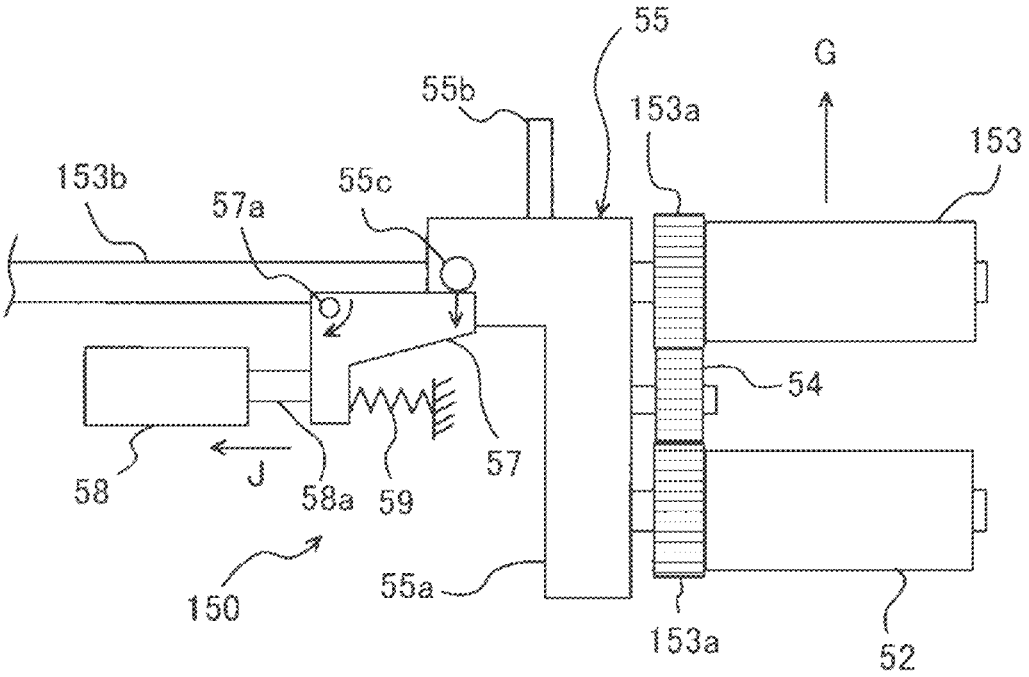
FIG. 5A is a schematic plan view of the bypass sheet feeding device.
Figure 5B:
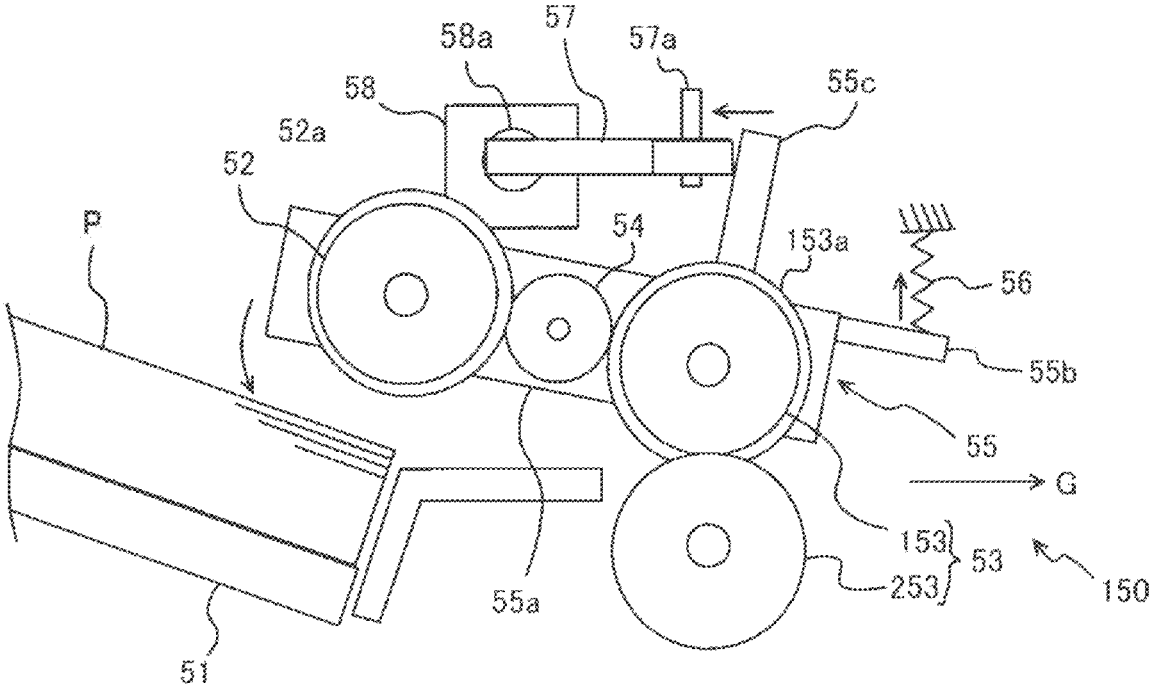
FIG. 5B is a schematic side view of the bypass sheet feeding device.

FIG. 5A is a schematic plan view of the bypass sheet feeding device 150. FIG. 5B is a schematic side view of the bypass sheet feeding device 150.

The arm 55 includes a contact projection 55*c* that extends in an upward direction in FIGS. 5A and 5B. The contact projection 55*c* is in contact with a movable member 57. The movable member 57 is rotatably supported by a support shaft 57*a* that is mounted on the frame of the image forming apparatus 1000. A solenoid 58 is attached to the movable member 57 to cause the bypass pickup roller 52 to contact with and separate from a recording sheet P. The movable member 57 is biased by a spring 59 toward a clockwise direction in FIG. 5A.

With this configuration, when the solenoid 58 is not in operation, the contact projection 55*c* is pushed by the biasing force of the spring 59 toward a sheet conveyance direction. Accordingly, the arm 55 rotates in the clockwise direction in FIG. 5B against the biasing force of the spring 56, and therefore the bypass pickup roller 52 is located at a standby position at which the bypass pickup roller 52 is separated away from the recording sheet P.

As the solenoid 58 is driven to pull a plunger 58*a* in a direction indicated by arrow J in FIG. 5A, the movable member 57 rotates about the support shaft 57*a* in a direction to separate from the contact projection 55*c* in FIG. 5A. Then, the contact projection 55*c* moves so as to follow the movable member 57 by the biasing force of the spring 56, and the arm 55 rotates in the counterclockwise direction in FIG. 5B. Accordingly, the bypass pickup roller 52 comes into contact with the recording sheet P loaded on the bypass tray 51.

Figure 6:
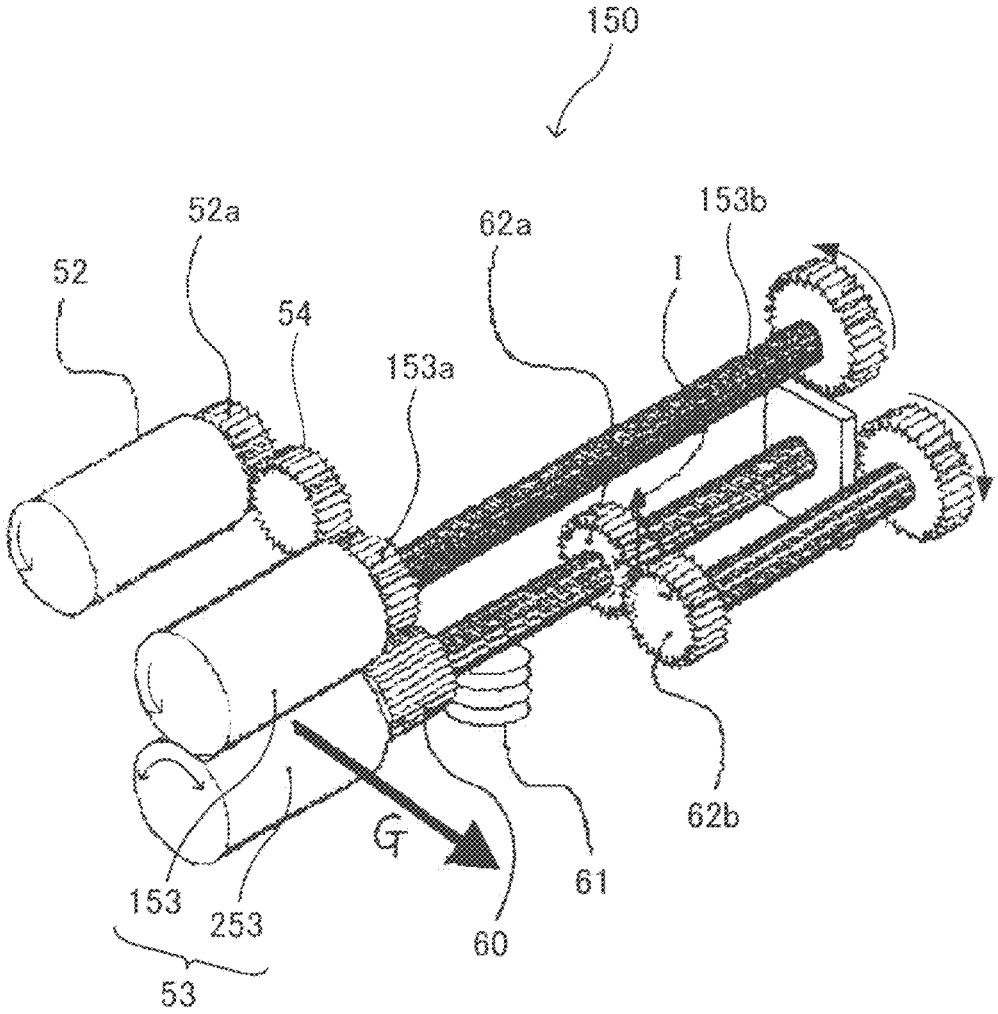
FIG. 6 is a diagram illustrating a recording sheet separating operation of the bypass sheet feeding device.

FIG. 6 is a diagram illustrating a recording sheet separating operation performed by the bypass sheet feeding device 150.

First, the solenoid 58 is driven to move the bypass pickup roller 52 at the standby position at which the bypass pickup roller 52 is separated from the recording sheet P loaded on the bypass tray 51, to a sheet feeding position at which the bypass pickup roller 52 contacts the uppermost recording sheet P of the sheet bundle loaded on the bypass tray 51. Next, the drive motor is driven to rotate the bypass feed roller 153 and the bypass pickup roller 52. Consequently, the recording sheet P of the sheet bundle on the bypass tray 51 is conveyed by a frictional force of the bypass pickup roller 52, to a bypass separation nip region at which the bypass feed roller 153 and the bypass reverse roller 253 contact each other.

As illustrated in FIG. 6, a torque limiter 60 and an input gear 62*a* are mounted on a shaft of the bypass reverse roller 253. The input gear 62*a* meshes with a drive gear 62*b* that is mounted on a drive input shaft to which a driving force of the drive motor is transmitted. The driving force, which drives the bypass reverse roller 253 in an opposite direction opposite a rotational direction of the bypass feed roller 153, is input to the bypass reverse roller 253 via the drive gear 62*b*, the input gear 62*a*, and the torque limiter 60. The torque limiter 60 is configured to cause the bypass reverse roller 253 to spin relative to the torque limiter 60 when a running torque (a rotational torque) of the bypass reverse roller 253 in an opposite direction opposite the rotational direction of the bypass feed roller 153 exceeds a given value.

The bypass reverse roller 253 is in contact with and pressed against the bypass feed roller 153 by a tooth surface pressure between the drive gear 62*b* and the input gear 62*a* and the biasing force of the spring 61.

While the bypass reverse roller 253 is in contact with the bypass feed roller 153 or when a single sheet (one sheet) is conveyed to the sheet separation nip region, the bypass reverse roller 253 receives a rotation driving force of the bypass feed roller 153. Therefore, the running torque (the rotational torque) of the bypass reverse roller 253, which is applied in the opposite direction to the rotational direction of the bypass feed roller 153, exceeds the given value. Hence, in this case, the bypass reverse roller 253 spins relative to the torque limiter 60 and rotates together with the bypass feed roller 153, thereby conveying the recording sheet P in a direction indicated by arrow G.

By contrast, when a plurality of recording sheets P is conveyed to the sheet separation nip region, a running torque of the bypass reverse roller 253 applied in the opposite direction to the rotational direction of the bypass feed roller 153 becomes smaller due to slippage generated between recording sheets of the plurality of recording sheets P. As a result, a driving force that rotates in the opposite direction to the rotational direction of the bypass feed roller 153 is transmitted to the bypass reverse roller 253 via the torque limiter 60, and the bypass reverse roller 253 rotates in the opposite direction to the rotational direction of the bypass feed roller 153. Accordingly, of the plurality of recording sheets P nipped in the sheet separation nip region, second and subsequent recording sheets P except the uppermost recording sheet P are conveyed in a direction to return to the bypass tray 51 along with rotation of the bypass reverse roller 253. Accordingly, the second and subsequent recording sheets P of the plurality of recording sheets P are returned to the bypass tray 51. According to this configuration, the recording sheet P (i.e., the uppermost recording sheet P) on the bypass tray 51 is separated and conveyed by the bypass separation and conveyance unit 53.

Figure 7:
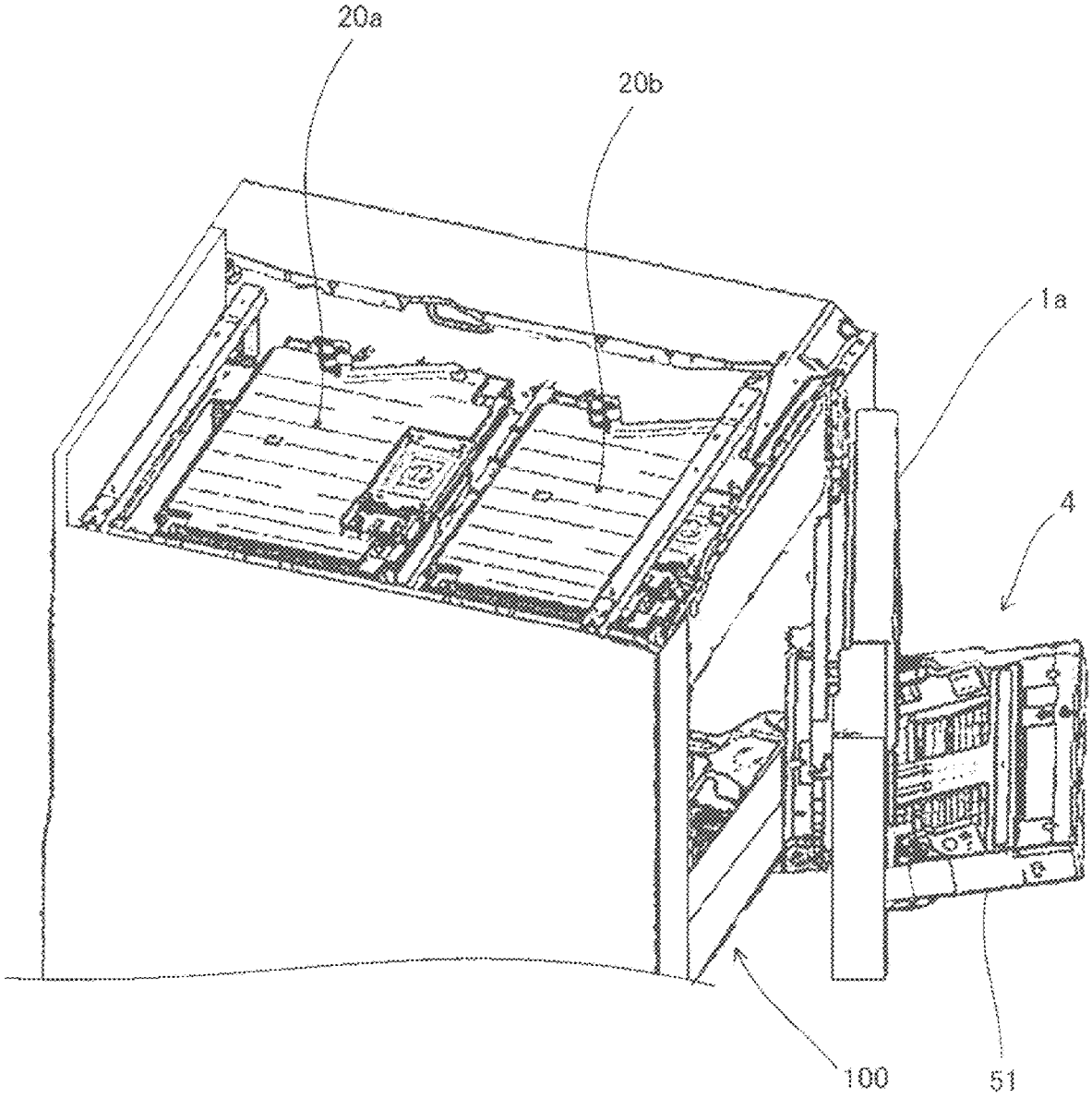
FIG. 7 is a schematic perspective view illustrating an image forming device.

FIG. 7 is a schematic perspective view illustrating an image forming device 1 of the image forming apparatus 1000.

As illustrated in FIG. 7, the bypass sheet feeding device 4 is attached to (mounted on) a side cover 1*a*. The side cover 1*a* moves about the far side (the rear side) of the image forming apparatus 1000 to open and close with respect to a housing frame 100.

Figure 8:
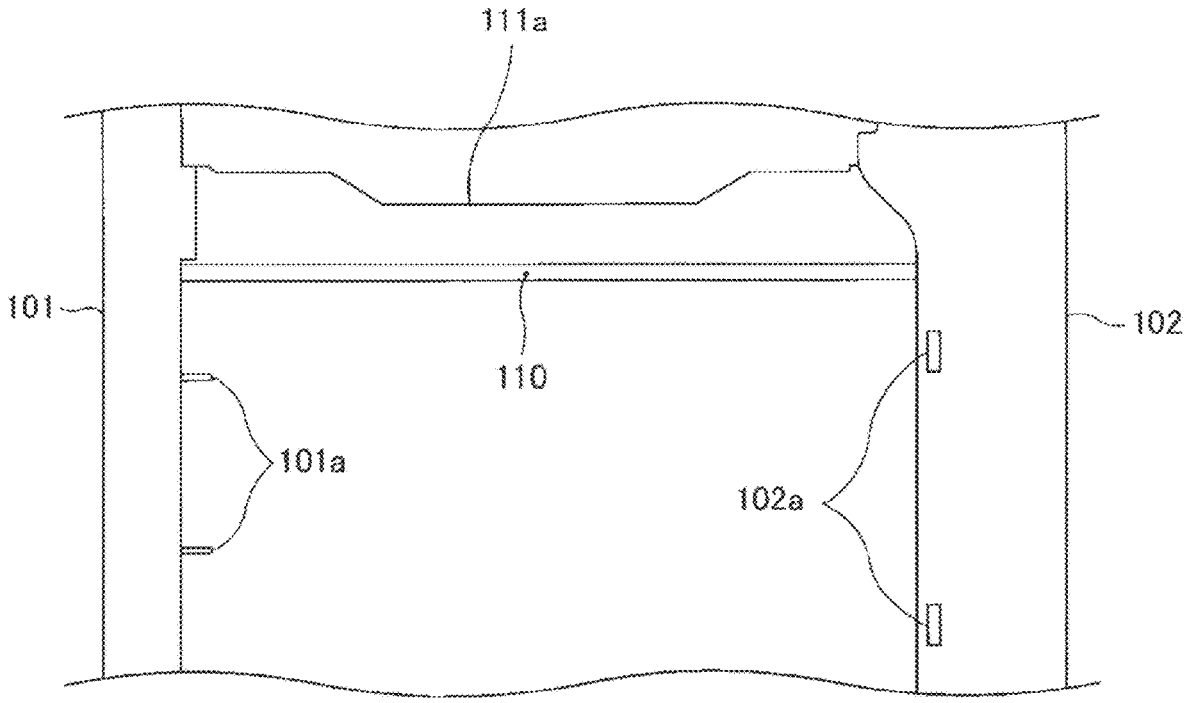
FIG. 8 is a diagram illustrating a schematic configuration of a housing frame of the image forming device, viewed from a side cover.

FIG. 8 is a diagram illustrating a schematic configuration of the housing frame 100 of the image forming device 1, viewed from the side cover 1*a*.

As illustrated in FIG. 8, the housing frame 100 is a framework of the image forming apparatus 1000 and includes four supports, which are a first front-side support 101, a first rear-side support 102, a second front-side support 103, and a second rear-side support 104. The first rear-side support 102 is disposed at a position close to the side cover 1*a* on the rear side of the image forming apparatus 1000. The first rear-side support 102 includes two cover support pins 102*a* at a given interval in a vertical direction. The cover support pins 102*a* rotatably support the side cover 1*a*. The first front-side support 101 is disposed at a position close to the side cover 1*a* on the front side of the image forming apparatus 1000. The first front-side support 101 includes two positioning pins 101*a* at a given interval in the vertical direction. The positioning pins 101*a* are used to position the side cover 1*a*.

It is to be noted that, in FIG. 8, a partition 110 is disposed to separate or partition the writing units (i.e., the first writing unit 20*a* and the second writing unit 20*b*) and the photoconductors (i.e., the photoconductors 41Y, 41M, 41C, and 41K). Further, a front and rear stay 111*a* functions as a beam member provided in the housing frame 100.

Figure 9:
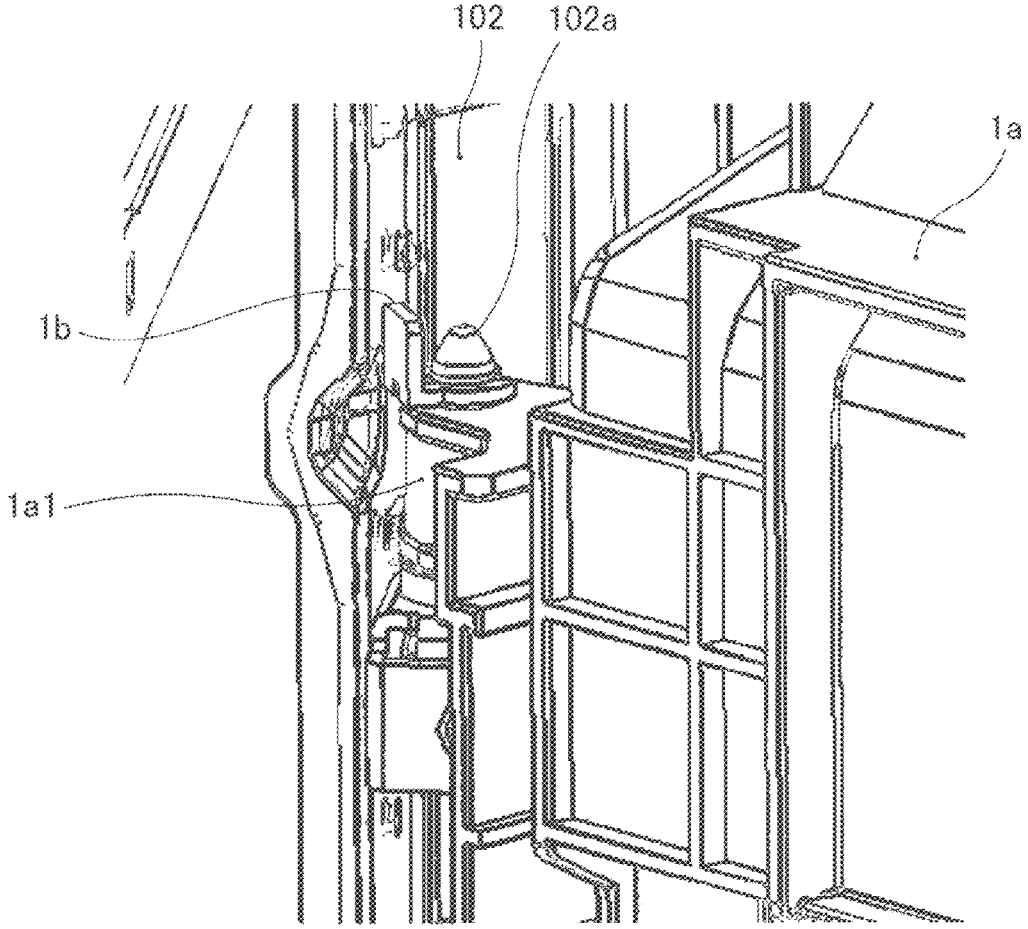
FIG. 9 is an enlarged perspective view illustrating the housing frame in the vicinity of a cover support pin, viewed from the inside of the image forming apparatus.

FIG. 9 is an enlarged perspective view illustrating the housing frame 100 in the vicinity of the cover support pin 102*a*, viewed from the inside of the image forming apparatus 1000. It is to be noted that FIG. 9 illustrates one of the cover support pins 102*a* but the same setting is made to both of the cover support pins 102*a*.

As illustrated in FIG. 9, the cover support pin 102*a* is inserted into an opening (a hole) of a cylindrical support portion 1*a*1 provided at an end portion on the rear side of the side cover 1*a*, and the retaining ring 1*b* is fitted into a groove at the tip of the cover support pin 102*a*. By so doing, the side cover 1*a* is rotatably supported by the cover support pin 102*a*.

Figure 10A:
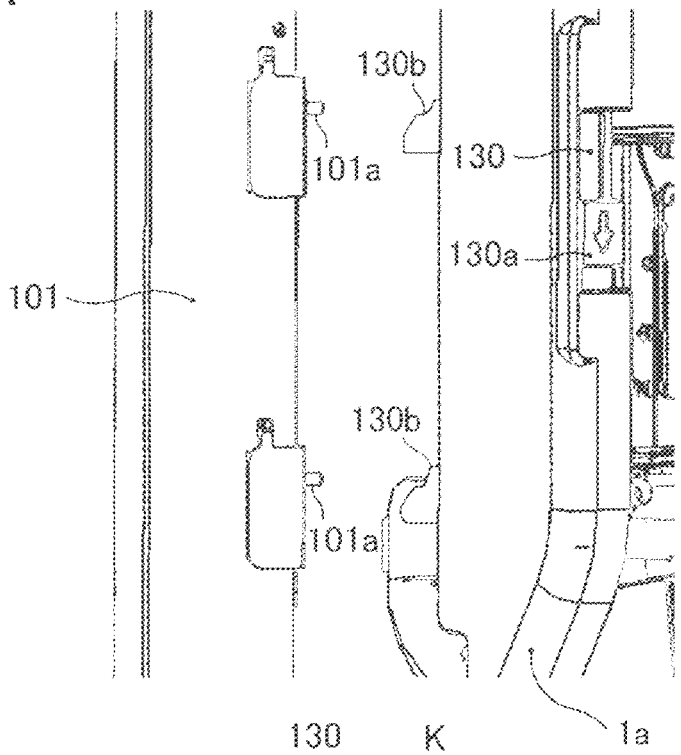
FIG. 10A is an enlarged perspective view illustrating the housing frame in the vicinity of a positioning pin, viewed from a side cover.
Figure 10B:
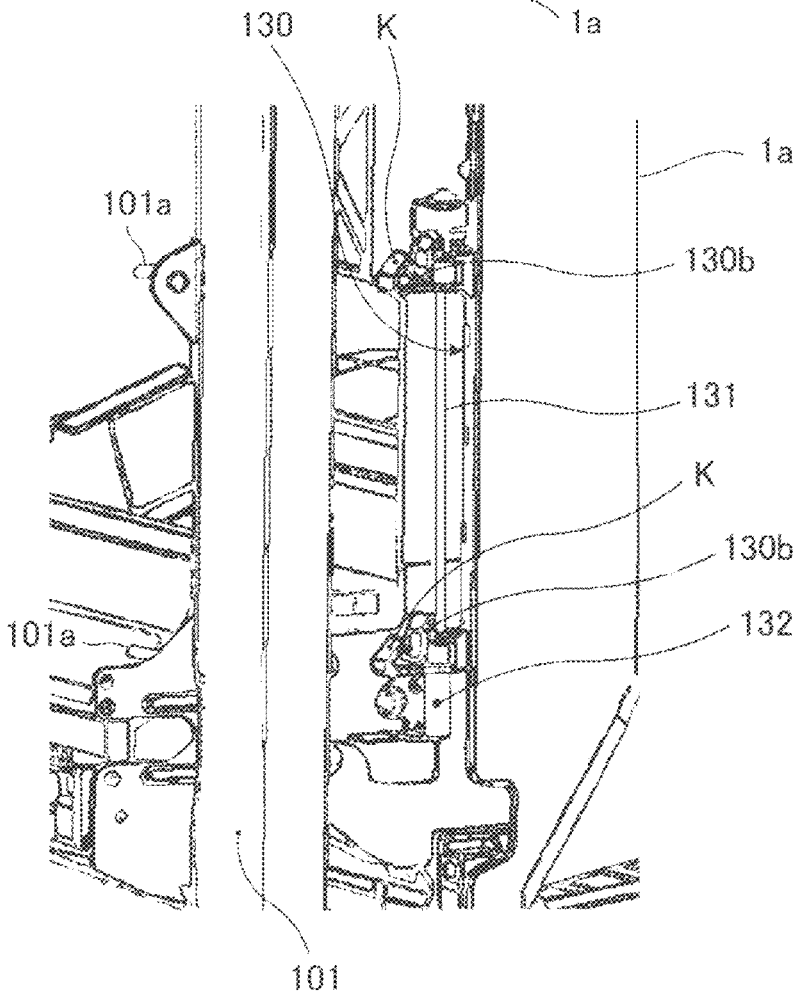
FIG. 10B is an enlarged perspective view illustrating the vicinity of the positioning pin of the housing frame, viewed from a front side of the housing frame.

FIG. 10A is an enlarged perspective view illustrating the housing frame 100 in the vicinity of the positioning pins 101*a*, viewed from the side cover 1*a*. FIG. 10B is an enlarged perspective view illustrating the vicinity of the positioning pins 101*a* of the housing frame 100, viewed from the front side of the housing frame 100.

As illustrated in FIGS. 10A and 10B, two claws 130*b* are disposed one end on the front side of the side cover 1*a*. The claws 130*b* are spaced apart at an interval in the vertical direction to be fitted to the respective positioning pins 101*a*. As illustrated in FIG. 10B, the claws 130*b* are mounted on a slide 130 that is attached to the side cover 1*a* to be movable within a given range in the vertical direction. The slide 130 is supported by a slide shaft 131 extending in the vertical direction. A coil spring 132 is inserted into the lower end of the slide shaft 131.

As illustrated in FIG. 10A, the slide 130 includes a lever 130*a* that is exposed from the side cover 1*a*. The lever 130*a* is pushed down by a user. A downward arrow mark is provided on the lever 130*a*.

When opening the side cover 1*a*, a user pushes the lever 130*a* downward according to the downward arrow mark on the lever 130*a*.

Then, the slide 130 moves downward against the biasing force of the coil spring 132. This movement of the slide 130 disengages the claws 130*b* from the positioning pins 101*a*, thereby enabling the side cover 1*a* to open and close relative to the housing frame 100. In this state, as the front side of the side cover 1*a* is pulled in a direction to separate from the housing frame 100, the side cover 1*a* rotates about the cover support pins 102*a* to open the side cover 1*a*.

When closing the side cover 1*a*, as a user rotates the side cover 1*a* in a direction to close relative to the housing frame 100, respective sloped faces K at the tips of the claws 130*b* come into contact the positioning pins 101*a*. In this state, as the side cover 1*a* is further closed, the slide 130 is pressed downward by the positioning pins 101*a*, so that the slide 130 moves downward against the biasing force of the coil spring 132. When the positioning pins 101*a* climb over the sloped faces K, the slide 130 moves upward due to the biasing force of the coil spring 132. According to the movement of the slide 130, the positioning pins 101*a* are engaged with the claws 130*b*, and therefore the side cover 1*a* is positioned to the housing frame 100.

As described above, when the side cover 1*a* is closed, the side cover 1*a* is positioned by the positioning pins 101*a*. Therefore, the bypass sheet feeding device 4 to which the side cover 1*a* is attached is positioned to a target position on the image forming device 1.

Figure 11:
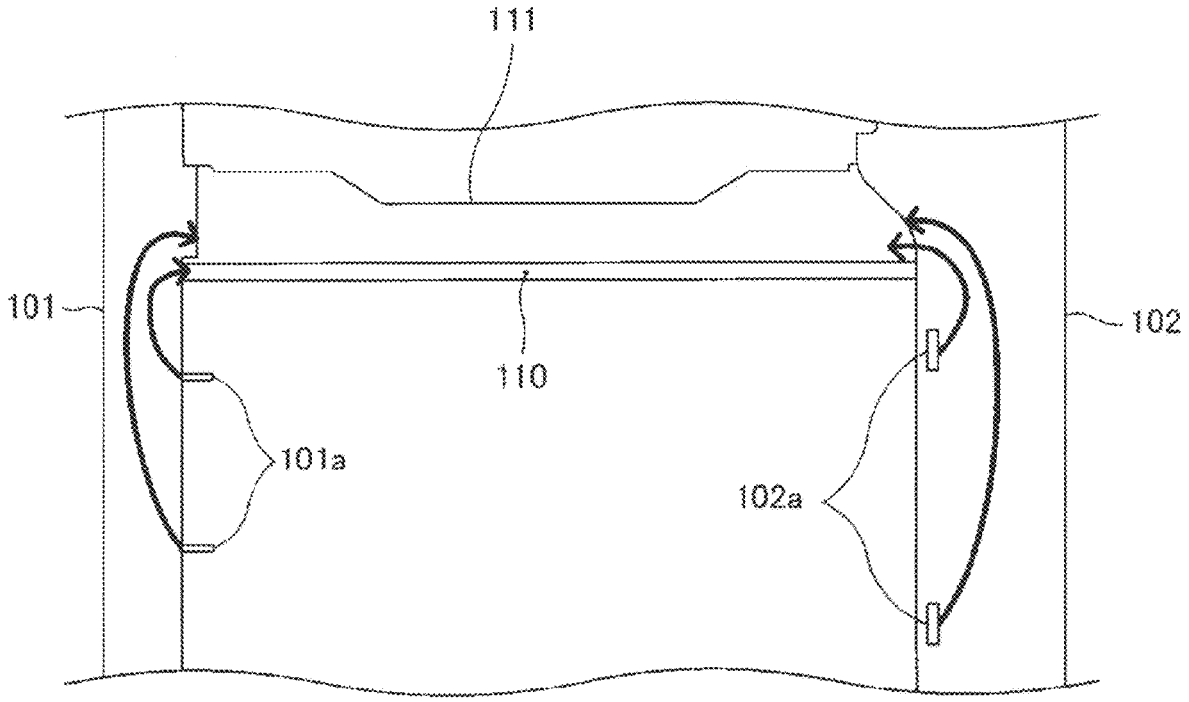
FIG. 11 is a diagram illustrating transmission of vibration generated when feeding a recording sheet set on a bypass tray.

FIG. 11 is a diagram illustrating transmission of vibration generated when feeding a recording sheet P set on the bypass tray 51.

When the solenoid 58 is activated to cause the bypass pickup roller 52 to contact the recording sheet P loaded on the bypass tray 51, vibrations are generated in each direction. Of the vibrations generated in each direction, the vibration in the vertical direction adversely affects image formation, for example, producing images with horizontal stripes. The vibration generated when the bypass pickup roller 52 contacts a recording sheet P loaded on the bypass tray 51 is transmitted from the bypass sheet feeding device 4 to the side cover 1*a*, and then to the first front-side support 101 and the first rear-side support 102 of the housing frame 100 via the positioning pins 101*a* and the cover support pins 102*a*. Then, as indicated by arrows in FIG. 11, these vibrations are transmitted from the first front-side support 101 and the first rear-side support 102 to the partition 110 that divides or partitions the photoconductors 41 (i.e., the photoconductors 41Y, 41M, 41C, and 41K) and the writing units 20 (i.e., the first writing unit 20*a* and the second writing unit 20*b*).

The partition 110 is attached to the housing frame 100 in a direction perpendicular to the vertical direction. In other words, the partition 110 is attached to the housing frame 100 in a horizontal direction. The partition 110 is a thin plate across the vertical direction, and is therefore deformable in the vertical direction. Therefore, among the vibrations generated when feeding the recording sheet P, when the vibration in the vertical direction is transmitted to the partition 110, the partition 110 significantly vibrates in the vertical direction.

Figure 12:
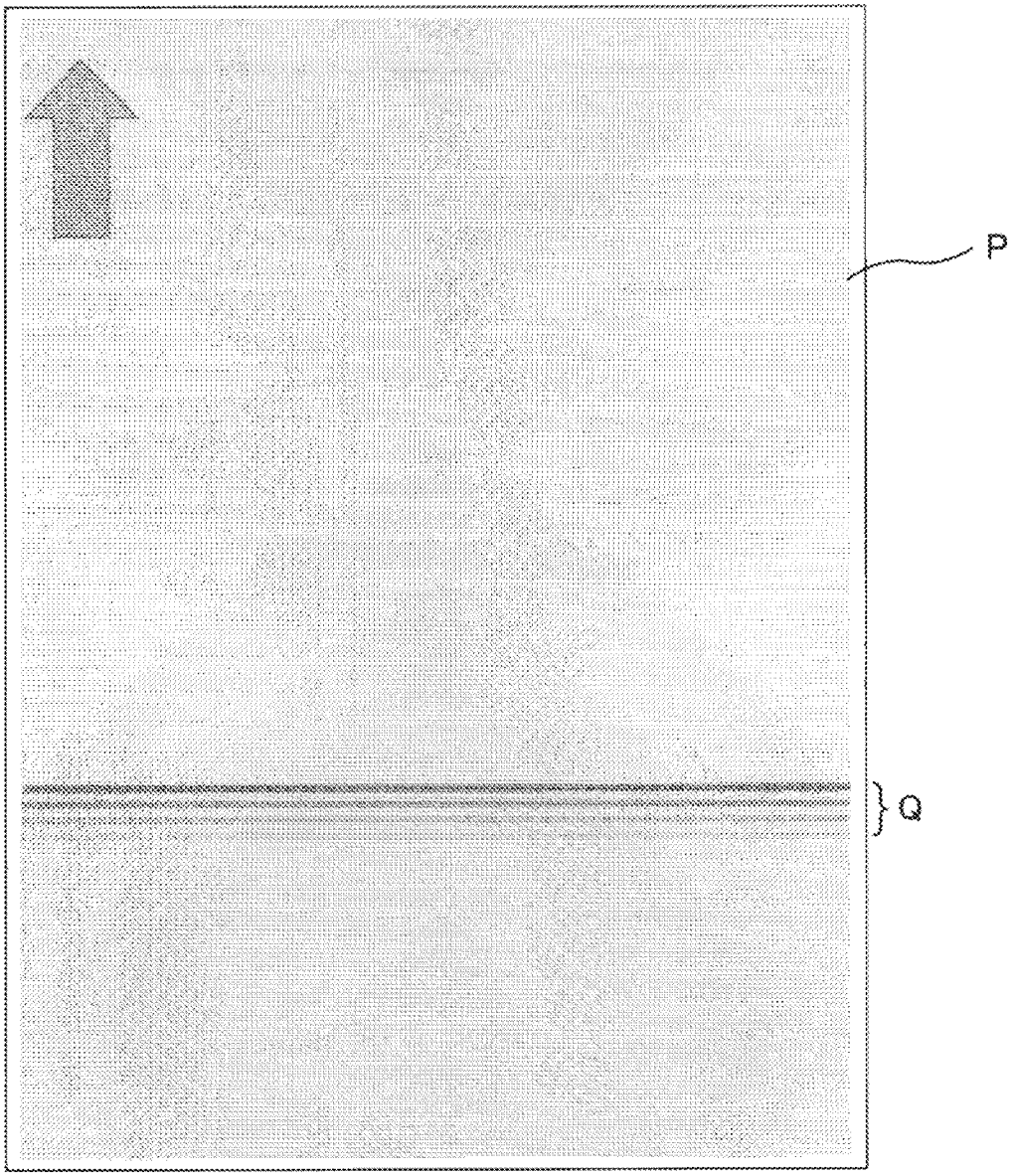
FIG. 12 is a diagram illustrating an example of a horizontal stripe image generated by vibration of the writing unit.

FIG. 12 is a diagram illustrating an example of a horizontal stripe image generated by vibration of the first writing unit 20*a* and the second writing unit 20*b*.

There is a case in which the first writing unit 20*a* and the second writing unit 20*b* are supported directly to the partition 110. There is another case in which a writing stay functioning as an attachment member, to which the writing units 20 (i.e., the first writing unit 20*a* and the second writing unit 20*b*) are attached, is fastened to the partition 110, and therefore are supported by the partition 110. In these cases, the first writing unit 20*a* and the second writing unit 20*b* significantly vibrate together with the partition 110. In a case in which a latent image is written to the photoconductor 41 (i.e., the photoconductors 41Y, 41M, 41C, and 41K) while the first writing unit 20*a* and the second writing unit 20*b* are vibrating, the writing position of laser light to be emitted onto the photoconductor 41 (in other words, an emission position of laser light on the photoconductor 41) changes to the sub-scanning direction. As a result, as illustrated in FIG. 12, it is likely that a horizontal streak image Q, which extends in a direction perpendicular to the sheet conveyance direction, is generated on an image formed on the recording sheet P.

Figure 13:
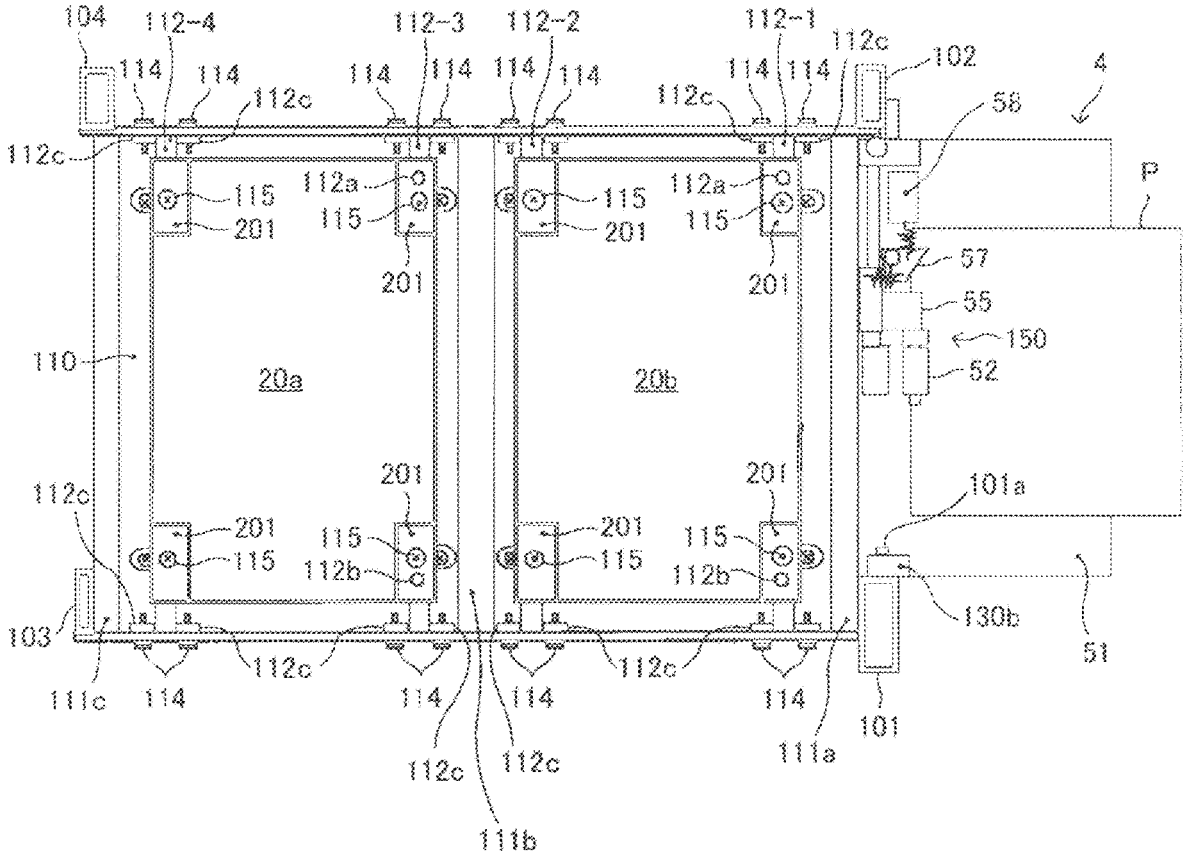
FIG. 13 is a schematic plan view illustrating the housing frame according to the present embodiment.
Figure 14A:
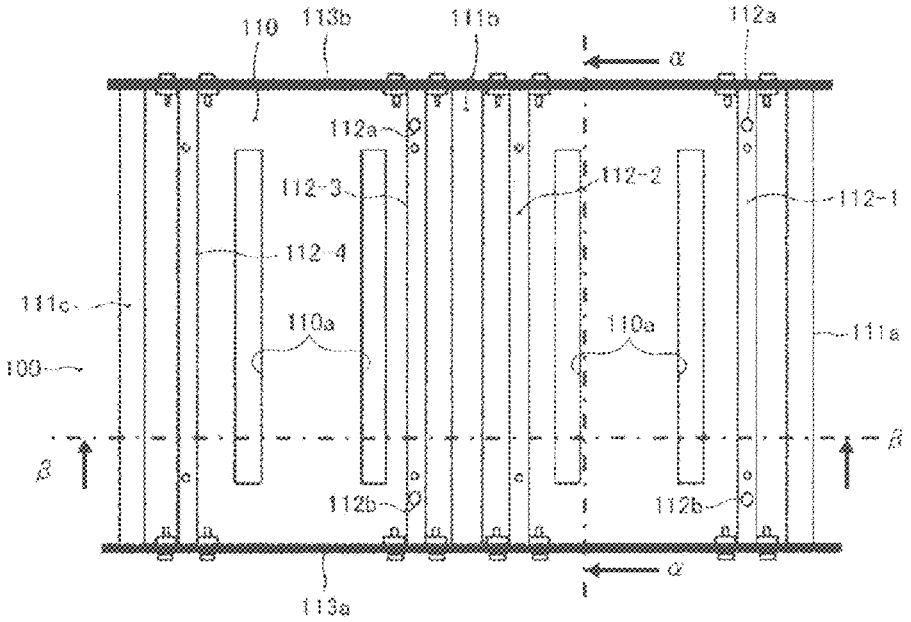
FIGS. 14A, 14B, and 14C are diagrams illustrating a schematic configuration of the housing frame with the writing units removed.
Figure 14B:
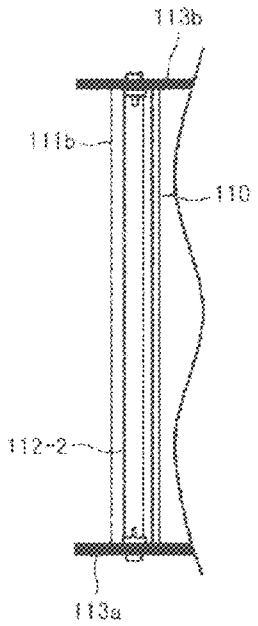
Figure 14C:
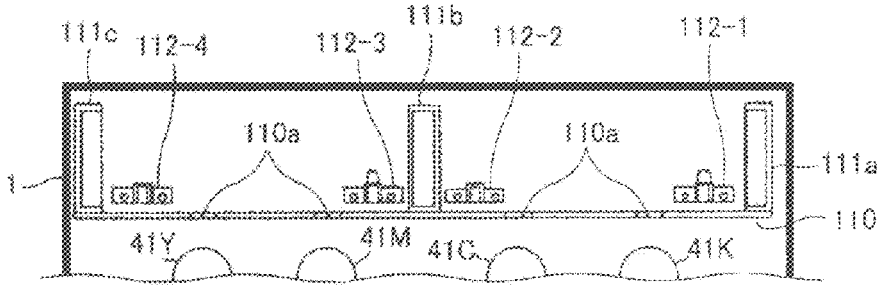

FIG. 13 is a schematic plan view illustrating the housing frame 100 according to the present embodiment. FIG. 14A is a plan view illustrating a schematic configuration of the housing frame 100 with the first writing unit 20*a* and the second writing unit 20*b* removed. FIG. 14B is a cross sectional view of the housing frame 100, along a dotted line of α-α in FIG. 14A. FIG. 14C is a cross sectional view of the housing frame 100, along a dotted line of β-β in FIG. 14A.

As illustrated in FIGS. 13, 14A, 14B, and 14C, the housing frame 100 includes the first front-side support 101, the first rear-side support 102, the second front-side support 103, the second rear-side support 104, a front side panel 113*a*, and a rear side panel 113*b*. The front side panel 113*a* and the rear side panel 113*b* function as side members and are disposed facing each other and spaced apart at a given interval in the axial direction of the photoconductors 41. The front side panel 113*a* is fastened to the first front-side support 101 and the second front-side support 103, both are disposed on the front side of the housing frame 100. The rear side panel 113*b* is fastened to the first rear-side support 102 and the second rear-side support 104, both are disposed on the rear side of the housing frame 100. The housing frame 100 further includes three front and rear stays, which are a first front and rear stay 111*a*, a second front and rear stay 111*b*, and a third front and rear stay 111*c*. These front and rear stays (i.e., the first front and rear stay 111*a*, the second front and rear stay 111*b*, and the third front and rear stay 111*c*) function as beam members and are fastened to the front side panel 113*a*, the rear side panel 113*b*, and the partition 110. In other words, the first front and rear stay 111*a*, the second front and rear stay 111*b*, and the third front and rear stay 111*c* are aligned in a direction parallel to the partition 110 (i.e., the horizontal direction), at given intervals. To be more specific, the first front and rear stay 111*a* is disposed on the housing frame 100, at one end on a side closer to the bypass sheet feeding device 4, and the third front and rear stay 111*c* is disposed on the housing frame 100, at the other end on an opposite side to the bypass sheet feeding device 4. The second front and rear stay 111*b* is disposed between the first front and rear stay 111*a* and the third front and rear stay 111*c*, substantially at the center of the housing frame 100.

A first writing stay 112-1 and a second writing stay 112-2 are disposed (spaced apart) at a given interval between the first front and rear stay 111*a* and the second front and rear stay 111*b*. The first writing stay 112-1 and the second writing stay 112-2 function as attachment members. The second writing unit 20*b* is attached to the first writing stay 112-1 and the second writing stay 112-2 to write latent images to the photoconductor 41K for a black color image and the photoconductor 41C for a cyan color image. It is to be noted that the second writing unit 20*b*, the first writing stay 112-1, and the second writing stay 112-2 compose a writing device. Similarly, a third writing stay 112-3 and a fourth writing stay 112-4 are disposed (spaced apart) at a given interval between the second front and rear stay 111*b* and the third front and rear stay 111*c*. The third writing stay 112-3 and the fourth writing stay 112-4 function as attachment members. The first writing unit 20*a* is attached to the third writing stay 112-3 and the fourth writing stay 112-4 to write latent images to the photoconductor 41M for a magenta color image and the photoconductor 41Y for a yellow color image. It is to be noted that the first writing unit 20*a*, the third writing stay 112-3, and the fourth writing stay 112-4 compose a writing device.

To be more specific, as illustrated in FIG. 14A, two through holes 110*a* are provided on the partition 110, between the first front and rear stay 111*a* and the second front and rear stay 111*b*. The laser light of the second writing unit 20*b* passes through the through holes 110*a* to emit the photoconductors 41 (i.e., the photoconductors 41C and 41K). The first writing stay 112-1 is disposed between the first front and rear stay 111*a* and the through hole 110*a* on the near side of the bypass sheet feeding device 4. The second writing stay 112-2 is disposed between the second front and rear stay 111*b* and the through hole 110*a* on the far side of the bypass sheet feeding device 4.

Further, two through holes 110*a* are provided on the partition 110, between the second front and rear stay 111*b* and the third front and rear stay 111*c*. The third writing stay 112-3 is disposed between the second front and rear stay 111*b* and the through hole 110*a* on the near side of the bypass sheet feeding device 4. The fourth writing stay 112-4 is disposed between the third front and rear stay 111*c* and the through hole 110*a* on the far side to the bypass sheet feeding device 4.

Hereinafter, the first writing stay 112-1, the second writing stay 112-2, the third writing stay 112-3, and the fourth writing stay 112-4 are occasionally referred to as a writing stay 112 in a singular form when there is no need to particularly distinguish each writing stay. At both ends in the front-and-back direction (i.e., the axial direction of the photoconductor 41) of the writing stay 112, two fastening portions 112*c* that fasten the front side panel 113*a* and the rear side panel 113*b* are provided along a direction of alignment of the front and rear stays 111 (i.e., the first front and rear stay 111*a*, the second front and front and rear stay 111*b*, and the third front and rear stay 111*c*). Each writing stay 112 is fastened to the front side panel 113*a* and the rear side panel 113*b* by screws 114.

Thus, in the present embodiment, each writing stay 112 is fastened (fixed) to the front side panel 113*a* and the rear side panel 113*b* but is not fastened (fixed) to the partition 110. In other words, each writing stay 112 is fixed to the front side panel 113*a* and the rear side panel 113*b* and is spaced apart from the partition 110. With this configuration, the writing stay 112 does not vibrate together with the partition 110, thereby restraining vibration of the writing stay 112. Accordingly, vibrations of the first writing unit 20*a* and the second writing unit 20*b* supported by the writing stay 112 are restrained.

Further, in the present embodiment, each writing stay 112 is fastened to the front side panel 113*a* and the rear side panel 113*b* and not to the partition 110. With this configuration, vibration of the bypass sheet feeding device 4 is transmitted to the writing stay 112 via the front side panel 113*a* and the rear side panel 113*b*. The front side panel 113*a* and the rear side panel 113*b* are disposed in parallel in the vertical direction. Therefore, vibrations of the front side panel 113*a* and the rear side panel 113*b* are hardly transmitted in the vertical direction in comparison to the partition 110 that is disposed in a direction perpendicular to the vertical direction. Therefore, the vibration in the vertical direction from the bypass sheet feeding device 150 is significantly reduced even when the vibration is transmitted to each writing stay 112 via the front side panel 113*a* and the rear side panel 113*b*. As a result, vibration of each writing stay 112 is restrained, and vibrations of the first writing unit 20*a* and the second writing unit 20*b* supported by each writing stay 112 are also restrained. Consequently, production of images with horizontal streaks as illustrated in FIG. 12 is prevented.

Further, as illustrated in FIG. 14C, each writing stay 112 is fastened to the front side panel 113*a* and the rear side panel 113*b*, at a position spaced away from the partition 110, and therefore each writing stay 112 is not in contact with the partition 110. As described above, by disposing each writing stay 112 to be spaced away from the partition 110, vibration of the partition 110 is not transmitted directly. Accordingly, vibrations of the first writing unit 20*a* and the second writing unit 20*b* supported by the writing stay 112 are restrained.

Screw fastening portions 201 to be fastened to the writing stay 112 are provided at the four corners of the first writing unit 20*a* and the second writing unit 20*b*. Positioning holes are formed at the screw fastening portions 201 at both ends in the front-and-back direction of the first writing unit 20*a* and the second writing unit 20*b*, on the near side of the bypass sheet feeding device 4. A positioning projection 112*a* is provided on the rear side of the first writing stay 112-1 and another positioning projection 112*a* is provided on the rear side of the third writing stay 112-3. Similarly, a positioning projection 112*b* is provided on the front side of the first writing stay 112-1 and another positioning projection 112*b* is provided on the front side of the third writing stay 112-3. In addition, screw holes 112*d* are provided on the front side and the rear side of each writing stay 112. A screw groove is formed on an inner circumferential surface of each of the screw holes 112*d*. In addition, a base 112*f* is disposed around the screw hole 112*d* of each writing stay 112 (see FIG. 15) to increase the positional accuracy in each writing stay 112 in the vertical direction. The flatness of the bearing surface of the base 112*f* is set higher than the flatness of the surface of each writing stay 112.

The second writing unit 20*b* is positioned by the positioning projection 112*a* and the positioning projection 112*b*, provided on the first writing stay 112-1. Then, by screwing screws 115 into the respective screw holes 112*d* provided in the first writing stay 112-1 and the second writing stay 112-2, the second writing unit 20*b* contacts the base 112*f* (see FIG. 15). Therefore, the first writing stay 112-1 and the second writing stay 112-2 are fastened with the screws 115. The first writing unit 20*a* is positioned by the positioning projection 112*a* provided on the third writing stay 112-3. Then, by screwing the screws 115 into the respective screw holes 112*d* provided in the third writing stay 112-3 and the fourth writing stay 112-4, the first writing unit 20*a* contacts the base 112*f* (see FIG. 15). Therefore, the third writing stay 112-3 and the fourth writing stay 112-4 are fastened with the screws 115.

In the present embodiment, the writing units 20 are fastened to each writing stay 112, thereby fixing the writing units 20 to each writing stay 112 reliably and firmly. Consequently, the rattling of the writing units 20 is prevented, and therefore vibrations of the writing units 20 are restrained.

Each writing stay 112 is formed by bending a sheet metal. As illustrated in FIG. 14C, each writing stay 112 has a cross-sectional arch shape including a mounting face and a pair of reinforcement faces. The mounting face extends in the vertical direction, and the writing units 20 are mounted on the mounting face. The pair of reinforcement faces extends downward from both ends in the left and right directions (the horizontal direction) of the mounting face and perpendicular to the mounting face. As described above, each writing stay 112 has a polygonal cross-sectional shape with three faces. Therefore, the writing stay 112 has higher rigidity and is less affected by vibration, than the partition 110 having a planar shape. Accordingly, even when the vibration of the bypass sheet feeding device 150 is transmitted to the writing stay 112, the vibration of the writing stay 112 is restrained, and the vibration of the writing units 20 supported by the writing stay 112 is therefore restrained.

Further, in the present embodiment, the contact face of the writing stay 112 on which the writing stay 112 contacts at least the writing units 20 (in other words, the bearing surface of the base 112*f*) is flat. Therefore, the writing units 20 are attached (mounted) stably, and the vibration of the writing units 20 are restrained.

Furthermore, in the present embodiment, the first writing unit 20*a* and the second writing unit 20*b* are fastened to the writing stays 112 alone, vibration of any other member is not transmitted to the first writing unit 20*a* and the second writing unit 20*b*, and therefore the first writing unit 20*a* and the second writing unit 20*b* are restrained from receiving such vibration. Accordingly, the vibrations to the first writing unit 20*a* and the second writing unit 20*b* are restrained or prevented.

Next, a detailed description is given of attachment of the writing stay 112 to the front side panel 113*a* and the rear side panel 113*b*. Each writing stay 112 functions as an attachment member to which the writing unit is attached and as a positioner to position the writing units along the vertical direction. Therefore, each writing stay 112 is positioned and attached to the front side panel 113*a* and the rear side panel 113*b* in the vertical direction. In the following description, attachment of the first writing stay 112-1 is described. However, it is to be noted that the second writing stay 112-2, the third writing stay 112-3, and the fourth writing stay 112-4 are attached to corresponding side panel in the same steps as the first writing stay 112-1.

Figure 15A:
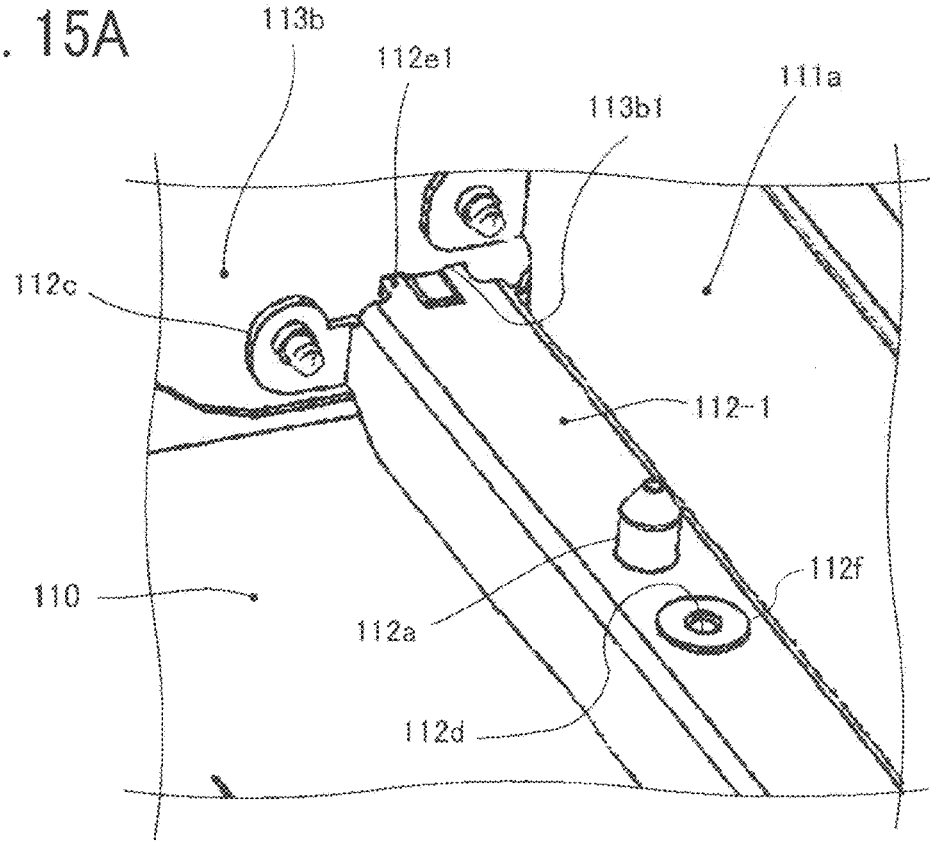
FIG. 15A is an enlarged perspective view of the first writing stay in the vicinity of the rear side panel.
Figure 15B:
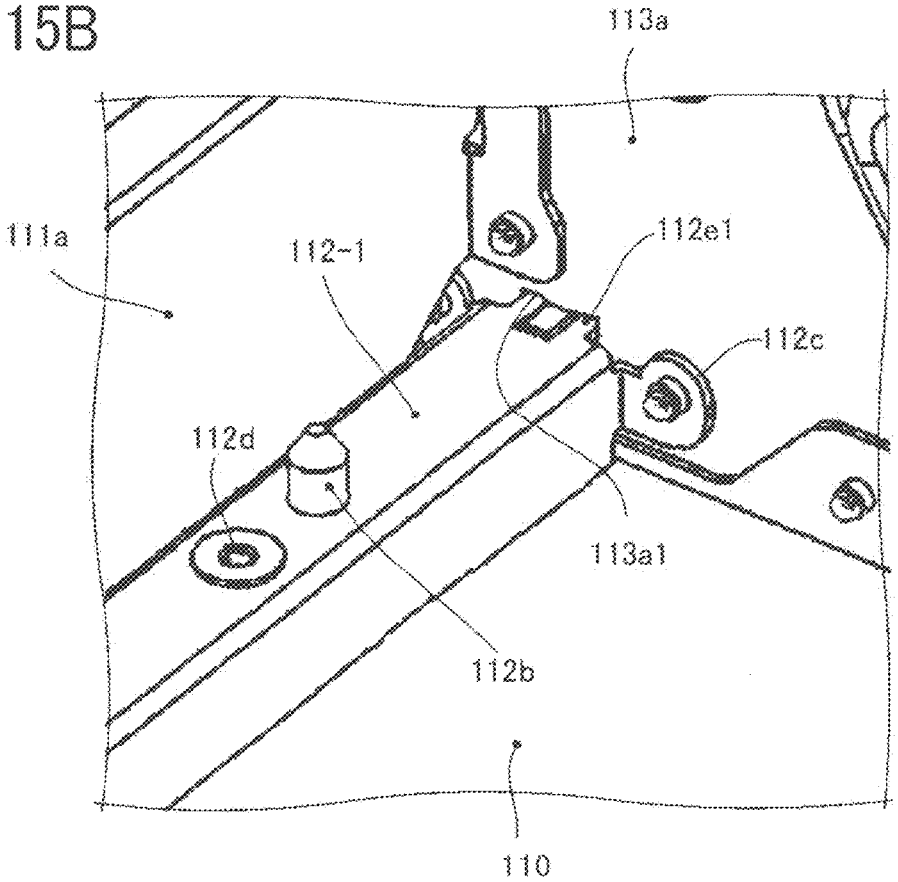
FIG. 15B is an enlarged perspective view of the first writing stay in the vicinity of the front side panel.

FIG. 15A is an enlarged perspective view of the first writing stay 112-1 in the vicinity of the rear side panel 113*b*. FIG. 15B is an enlarged perspective view of the first writing stay 112-1 in the vicinity of the front side panel 113*a*.

As illustrated in FIG. 15A, the rear side panel 113*b* has a rear-end positioning hole 113*b*1 to position the rear end of the first writing stay 112-1. A rear-end positioning projection 112*e*1 is provided at the rear end of the first writing stay 112-1. The rear-end positioning projection 112*e*1 of the first writing stay 112-1 is fitted into the rear-end positioning hole 113*b*1, so that the rear side of the first writing stay 112-1 is positioned in the vertical direction.

Further, as illustrated in FIG. 15B, the front side panel 113*a* has a front-end positioning hole 113*a*1 to position the front end of the first writing stay 112-1. A front-end positioning projection 112*e*2 is provided at the front end of the first writing stay 112-1. The front-end positioning projection 112*e*2 of the first writing stay 112-1 is fitted into the front-end positioning hole 113*a*1, so that the front side of the first writing stay 112-1 is positioned in the vertical direction.

As described above, the first writing stay 112-1 is fixed (fastened) to the front side panel 113*a* and the rear side panel 113*b* while being positioned to the front side panel 113*a* and the rear side panel 113*b* in the vertical direction. According to this configuration, the first writing stay 112-1 is accurately mounted on the target position in the vertical direction on the housing frame 100. Similarly, other writing stays, which are the second writing stay 112-2, the third writing stay 112-3, and the fourth writing stay 112-4, are mounted on the front side panel 113*a* and the rear side panel 113*b*. Accordingly, the first writing unit 20*a* and the second writing unit 20*b* to be fastened to each writing stay 112 are attached to (mounted on) the target position in the vertical direction.

Figure 16:
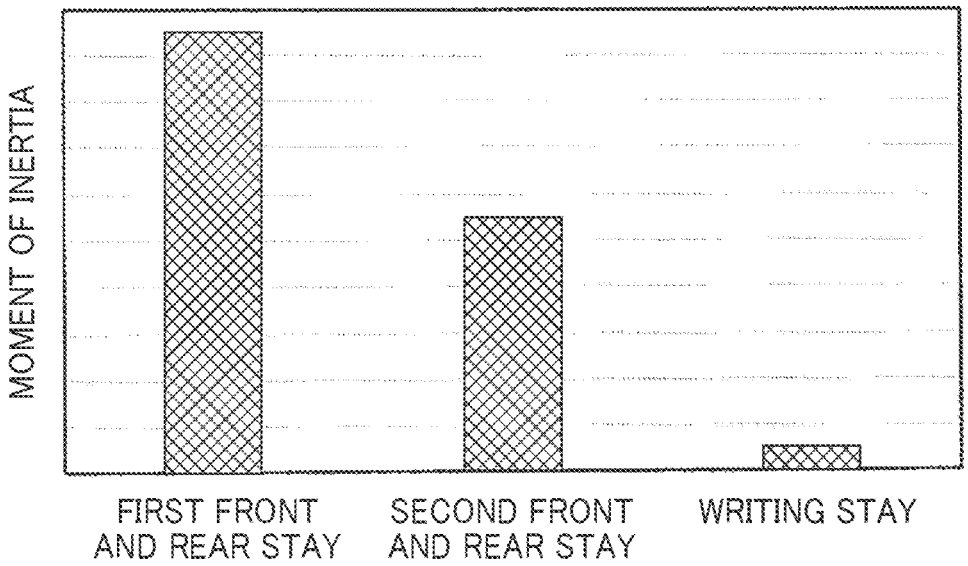
FIG. 16 is a graph illustrating a moment of inertia of the front and rear stay and a moment of inertia of the writing stay.
Figure 17:
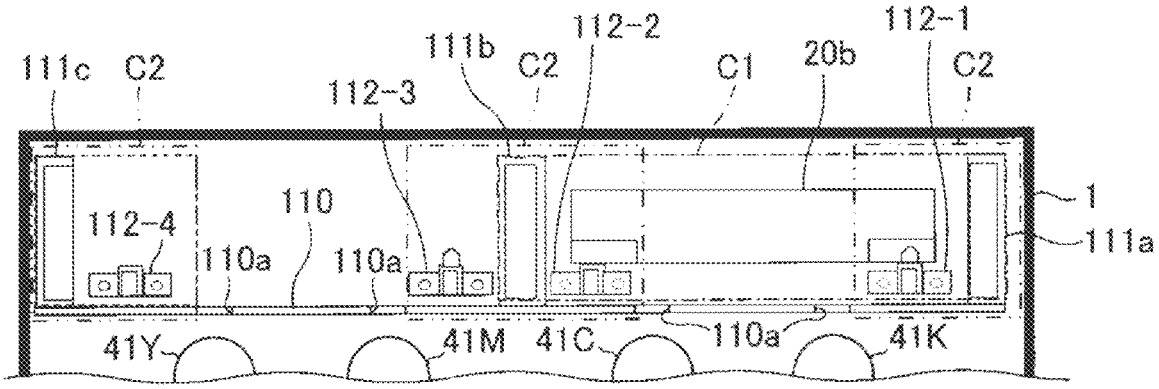
FIG. 17 is a diagram illustrating a layout of the writing stay.

FIG. 16 is a graph illustrating moments of inertia of the first front and rear stay 111*a*, the second front and rear stay 111*b*, and the writing stay 112. FIG. 17 is a diagram illustrating a layout of the writing stays 112.

As illustrated in FIG. 16, the moment of inertia of the first front and rear stay 111*a* and the moment of inertia of the second front and rear stay 111*b* are far greater than the moment of inertia of the writing stays 112. In the present embodiment, the first front and rear stay 111*a*, the second front and rear stay 111*b*, and the writing stay 112 share the same material and the same lengths in the front-and-back directions. That is, the first front and rear stay 111*a* and the second front and rear stay 111*b* have flexural rigidity far stronger than the writing stays 112. It is to be noted that the flexural rigidity is expressed in the following equation: Flexural Rigidity=EI/L, where "E" represents Young's modulus, "I" represents the moment of inertia, and "L" represents the length in the front-and-back direction.

Further, the material of the front and rear stays and the material of the writing stay may be different from each other, the Young's modulus of the front and rear stays may be greater than the Young's modulus of the writing stay 112, and the flexural rigidity of the front and rear stays is greater than the flexural rigidity of the writing stay 112.

As described above, the front and rear stays having greater flexural rigidity are fastened to the front side panel 113*a* and the rear side panel 113*b*. By so doing, areas on the front side panel 113*a* and the rear side panel 113*b*, near the contact portions at which the front and rear stays contact the front side panel 113*a* and the rear side panel 113*b*, are less affected by vibration than areas other than the areas near the contact portions. Therefore, a region (i.e., a region C1 indicated by a broken line in FIG. 17) on the front side panel 113*a* and the rear side panel 113*b* between two front and rear stays (i.e., the first front and rear stay 111*a* and the second front and rear stay 111*b*) is an area to which vibration is hardly transmitted because the vibration is terminated (cut) near the contact portions at which the front and rear stays contact the front side panel 113*a* and the rear side panel 113*b*. Accordingly, by fastening the writing stay 112 at any position in the region C1 illustrated in FIG. 17 on the front side panel 113*a* and the rear side panel 113*b*, the vibration of the writing stay 112 is restrained preferably.

In the present embodiment, the second front and rear stay 111*b* is disposed at the center in the left-right direction of the image forming device 1. With this configuration, the writing stays 112 (i.e., the first writing stay 112-1, the second writing stay 112-2, the third writing stay 112-3, and the fourth writing stay 112-4) are disposed near the front and rear stays (i.e., the first front and rear stay 111*a*, the second front and rear stay 111*b*, and the third front and rear stay 111*c*). As a result, the writing stays 112 (i.e., the first writing stay 112-1, the second writing stay 112-2, the third writing stay 112-3, and the fourth writing stay 112-4) are fastened to the front side panel 113*a* and the rear side panel 113*b*, in the areas near the contact portions with the front and rear stay, which are the areas hardly affected by vibration (i.e., a region indicated by a broken line C2 in FIG. 17). Accordingly, vibration of the writing stays 112 are more restrained.

Next, a description is given of a verification experiment for verifying vertical vibration for a comparative example and the present embodiment. In the comparative example, each writing stay 112 is fastened to the partition 110.

Figure 18A:
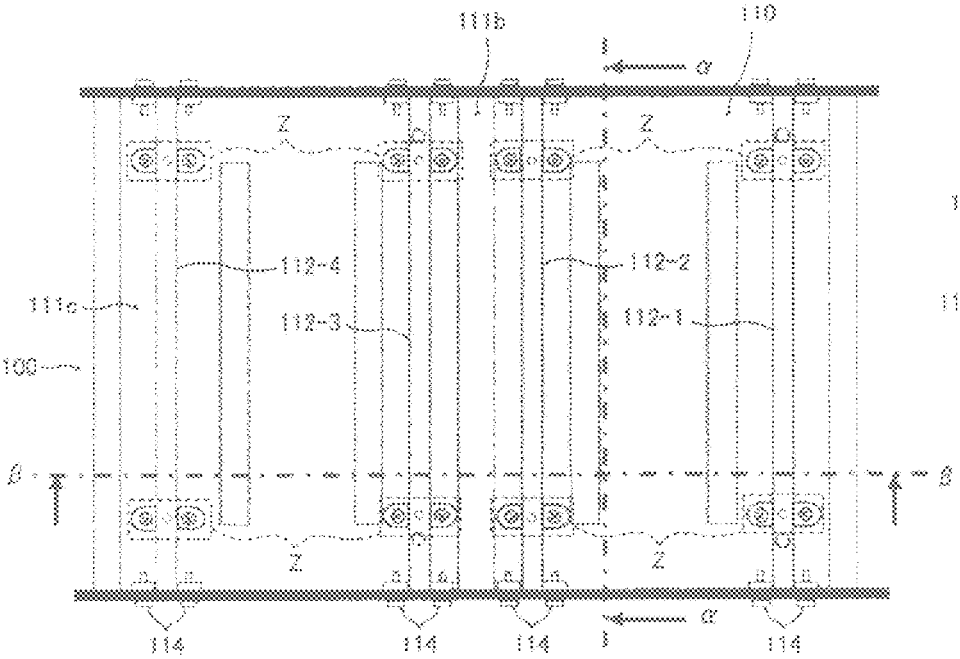
FIGS. 18A, 18B, and 18C are diagrams illustrating a schematic configuration of a main part of a comparative configuration.
Figure 18B:
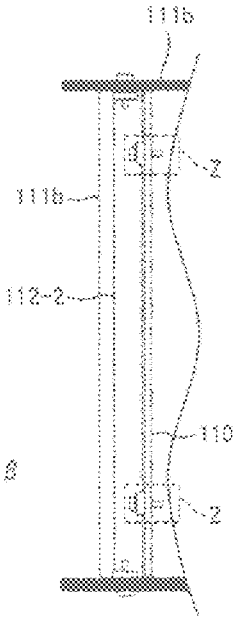
Figure 18C:
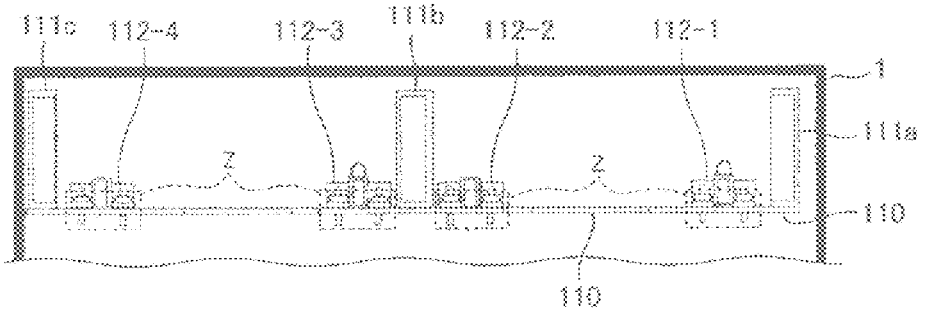

FIGS. 18A, 18B, and 18C are diagrams illustrating a schematic configuration of a main part of the comparative example.

To be more specific, FIG. 18A is a plan view illustrating a schematic configuration of a housing frame of the comparative example. FIG. 18B is a cross sectional view of the housing frame of the comparative example, along a dotted line of α-α in FIG. 18A. FIG. 18C is a cross sectional view of the housing frame of the comparative example, along a dotted line of β-β in FIG. 18A. As indicated by broken lines Z illustrated in FIGS. 18A, 18B, and 18C, in the comparative example, each writing stay 112 is fastened to the front side panel 113*a* and the rear side panel 113*b*, and two front portions and two rear portions of each writing stay 112 are fastened to the partition 110.

With respect to the comparative example and the present embodiment, the measurement was performed on vibration in the vertical direction (vertical vibration) of the bypass sheet feeding device 150 and vibration in the vertical direction (vertical vibration) of the first writing unit 20*a*.

Figure 19:
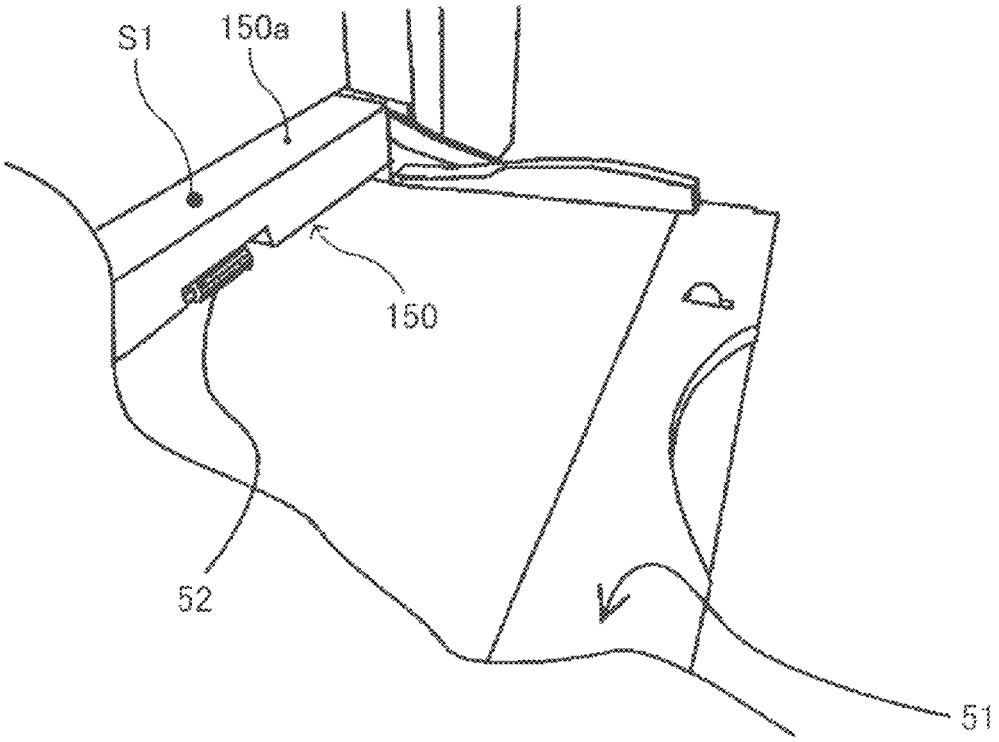
FIG. 19 is a diagram illustrating measurement points of vibration in the vertical direction of the bypass sheet feeding device.

FIG. 19 is a diagram illustrating measurement points of vibration in the vertical direction of the bypass sheet feeding device 150.

As indicated by a portion S1 illustrated in FIG. 19, vibration in the vertical direction of the bypass sheet feeding device 150 was measured at the approximate center in the front-and-back direction (the axial direction) of a bracket 150*a* that holds the solenoid 58 of the bypass sheet feeding device 150.

Figure 20:
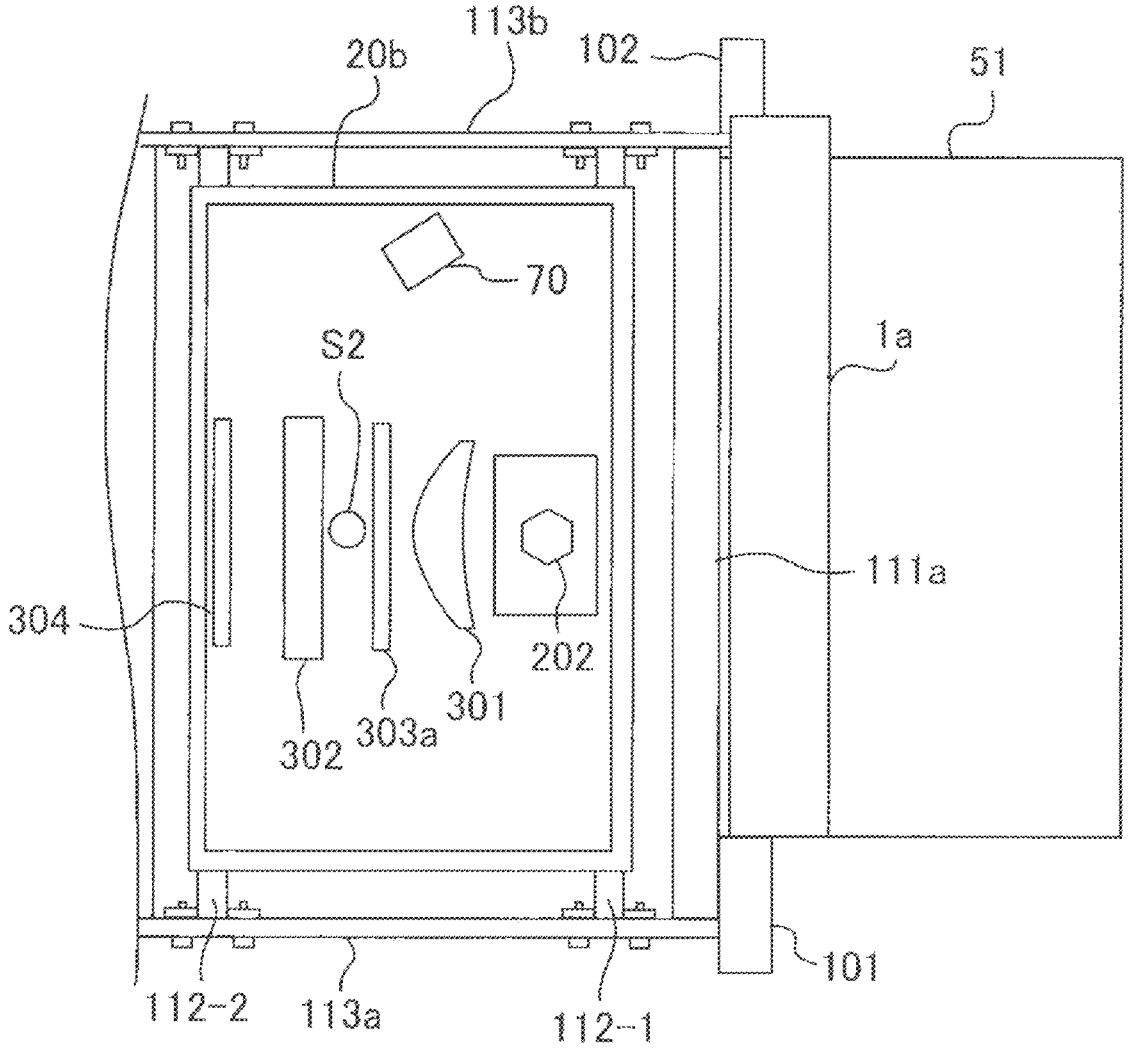
FIG. 20 is a diagram illustrating measurement points of vibration in the vertical direction of the second writing unit.

FIG. 20 is a diagram illustrating measurement points of vibration in the vertical direction of the second writing unit 20*b*.

As indicated by a portion S2 illustrated in FIG. 20, the vertical vibration of the second writing unit 20*b* was measured at the portion S2 between the first mirror 303*a* disposed on the optical path of laser light to be emitted to the photoconductor 41K (for forming a black color image) provided in the housing of the second writing unit 20*b* and the long lens 302 disposed on the optical path of laser light to be emitted to the photoconductor 41C (for forming a cyan color image) provided in the housing of the second writing unit 20*b*.

Figure 21A:
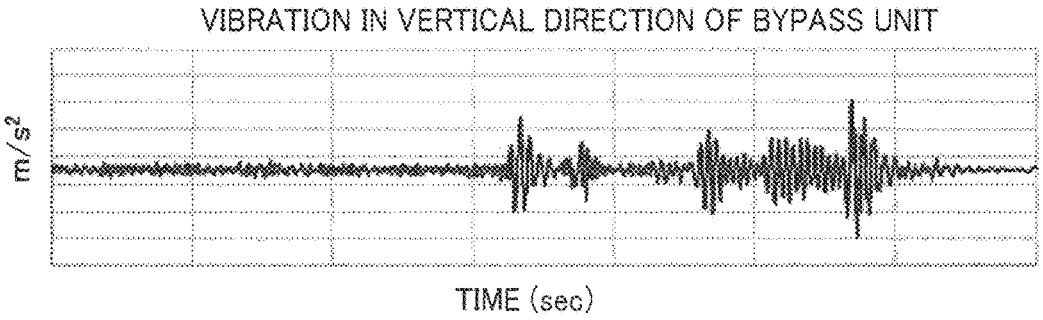
FIG. 21A is a graph illustrating a waveform of measured vibration in the vertical direction of a comparative bypass sheet feeding device.
Figure 21B:
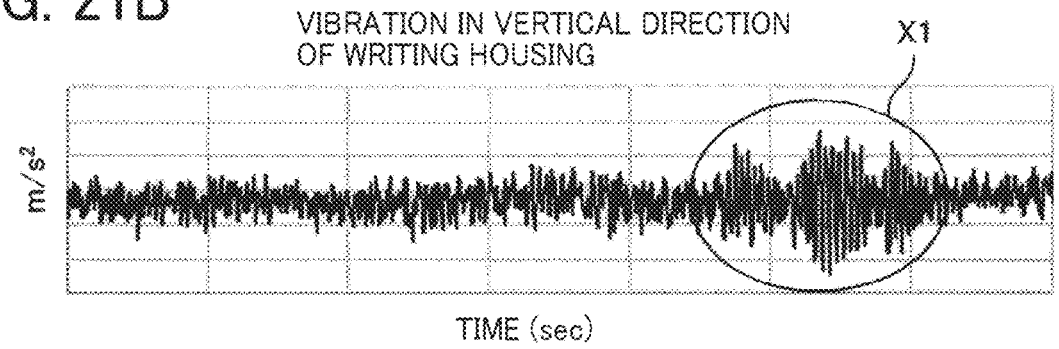
FIG. 21B is a graph illustrating a waveform of measured vibration in the vertical direction of a comparative second writing unit.
Figure 22A:
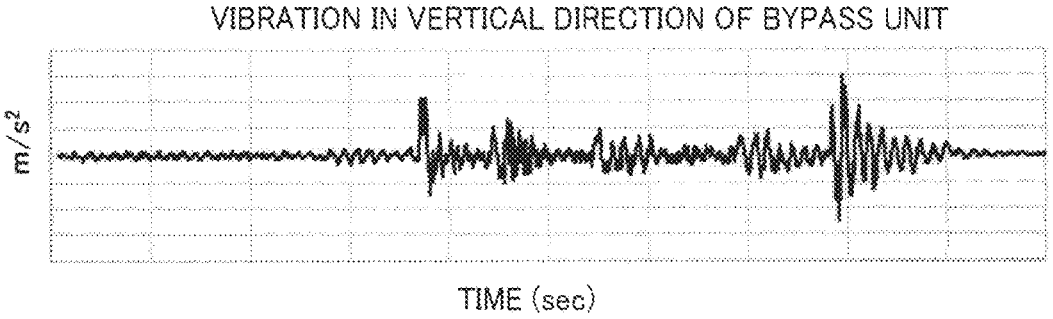
FIG. 22A is a graph illustrating a waveform of measured vibration in the vertical direction of the bypass sheet feeding device according to the present embodiment.
Figure 22B:
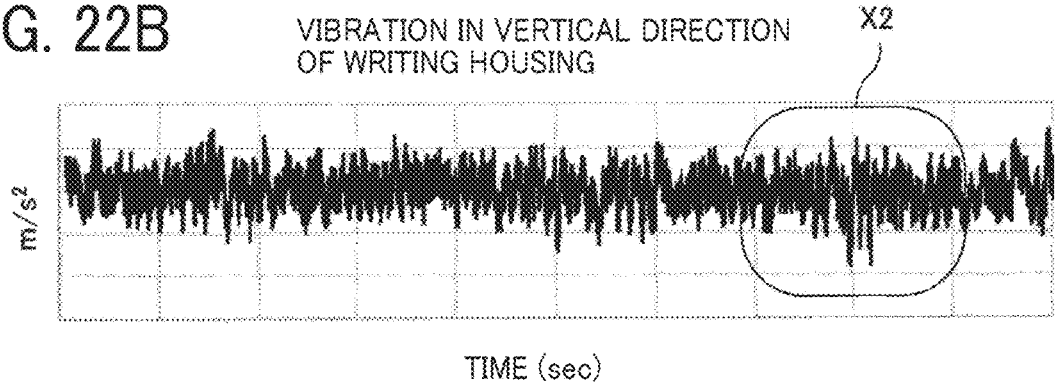
FIG. 22B is a graph illustrating a waveform of measured vibration in the vertical direction of the second writing unit according to the present embodiment.

FIG. 21A is a graph illustrating a waveform of measured vibration in the vertical direction of a comparative bypass sheet feeding device. FIG. 21B is a graph illustrating a waveform of measured vibration in the vertical direction of a comparative second writing unit. FIG. 22A is a graph illustrating a waveform of measured vibration in the vertical direction of the bypass sheet feeding device 150 of the present embodiment. FIG. 22B is a graph illustrating a waveform of measured vibration in the vertical direction of the second writing unit 20*b*.

For convenience, the comparative example employs the same reference numerals as the present embodiment. As can be clearly seen from an area X1 in FIG. 21B, the vertical vibration of the second writing unit 20*b* increases at a timing slightly delayed from a timing at which the bypass sheet feeding device 150 vibrates upward and downward. In the configuration of the comparative example, the writing stays 112 are fastened to the front side panel 113*a*, the rear side panel 113*b*, and the partition 110. Therefore, the vibration in the vertical direction of the bypass sheet feeding device 150 is transmitted to the partition 110, which vibrated the writing stays 112 together with the partition 110.

By contrast, in the present embodiment, as indicated by an area X2 illustrated in FIG. 22B, even at the timing slightly delayed from the timing at which the bypass sheet feeding device 150 vibrates upward and downward, the second writing unit 20*b* hardly vibrates in the vertical direction. As described above, it was confirmed that, by employing the configuration of the present embodiment, the vertical vibration of the bypass sheet feeding device 150 to be transmitted to the writing stays 112 is reduced, and that the vibration of the writing unit supported by the writing stays 112 is restrained.

Next, a description is given of a schematic configuration of a variation of the image forming apparatus 1000.

Figure 23A:
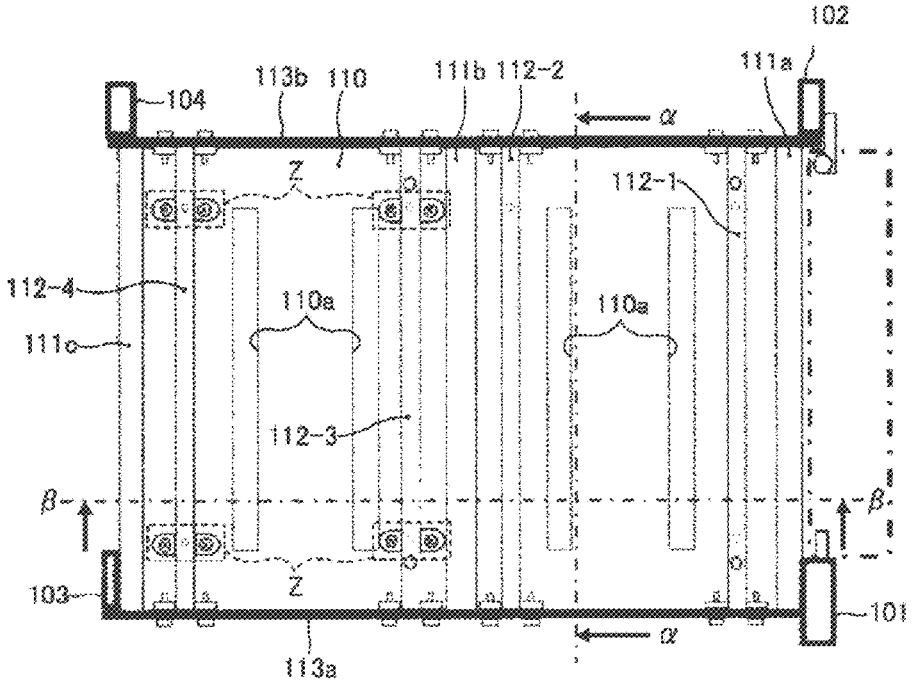
FIGS. 23A, 23B, and 23C are diagrams illustrating a main part of a variation.
Figure 23B:
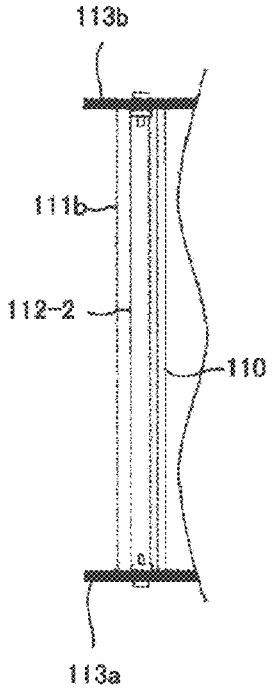
Figure 23C:
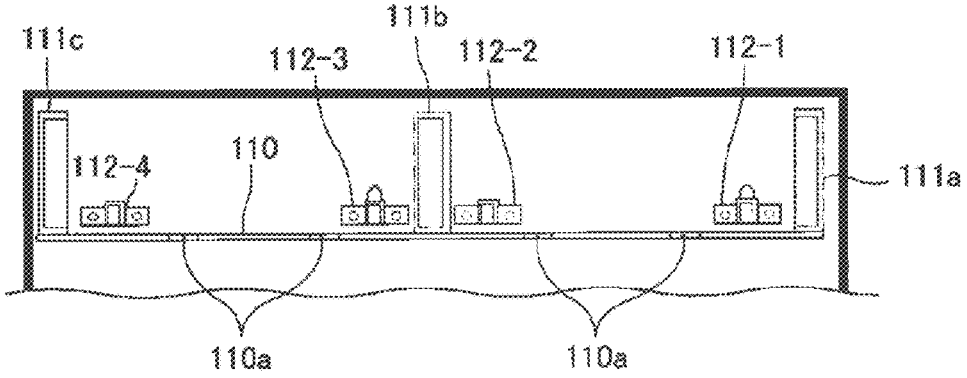

FIGS. 23A, 23B, and 23C are diagrams illustrating a schematic configuration of the main part of the variation. To be more specific, FIG. 23A is a plan view illustrating a schematic configuration of the housing frame 100 of the variation. FIG. 23B is a cross sectional view of the housing frame 100 of the variation, along a dotted line of α-α in FIG. 23A. FIG. 23C is a cross sectional view of the housing frame 100 of the variation, along a dotted line of β-β in FIG. 23A.

For convenience, the variation employs the same reference numerals as the present embodiment. As illustrated in FIGS. 23A, 23B, and 23C, the second writing unit 20*b* in the variation is disposed on the side close to the bypass sheet feeding device 150 that is a vibration source and is attached to the first writing stay 112-1 and the second writing stay 112-2. The first writing stay 112-1 and the second writing stay 112-2 in the variation are fastened to the front side panel 113*a* and the rear side panel 113*b* and not to the partition 110. By contrast, the first writing unit 20*a* in the variation is disposed on the side far from the bypass sheet feeding device 150 and is attached to the third writing stay 112-3 and the fourth writing stay 112-4. The third writing stay 112-3 and the fourth writing stay 112-4 in the variation are fastened to the front side panel 113*a*, the rear side panel 113*b*, and the partition 110.

In the comparative example illustrated in FIGS. 18A through 18C, the mechanical rigidity of the entire housing frame 100 may be increased by fastening the writing stay 112 to the partition 110 in addition to the front side panel 113*a* and the rear side panel 113*b*. However, as described above, if the writing stay 112 is fastened to the partition 110 in addition to the front side panel 113*a* and the rear side panel 113*b*, the writing units are likely to greatly vibrate in the vertical direction.

However, as the writing unit moves away from the bypass sheet feeding device 150 that is a vibration source, the vertical vibration attenuates. Further, the vibration in the vertical direction of the bypass sheet feeding device 150 is transmitted from the partition 110, on the near side of the bypass sheet feeding device 150. The vertical vibration of the bypass sheet feeding device 150 is transmitted from the partition 110, on the near side of the bypass sheet feeding device 150. The vertical vibration of the bypass sheet feeding device 150 is reduced at the contact portion on the second front and rear stay 111*b* that has the large flexural rigidity. As a result, vibration on the partition 110 generating on the far side of the bypass sheet feeding device 150 from the second front and rear stay 111*b* is more reduced (smaller) than vibration on the partition 110 generating on the near side of the bypass sheet feeding device 150 from the second front and rear stay 111*b*. Therefore, even though the third writing stay 112-3 and the fourth writing stay 112-4 are fastened to the partition 110, the writing units do not vibrate largely together with the partition 110. Accordingly, the first writing unit 20*a* that is attached to the third writing stay 112-3 and the fourth writing stay 112-4 does not vibrate greatly. In other words, the second writing unit 20*b* that is disposed closer to the vibration source vibrates largely. Therefore, a writing unit disposed closest to a vibration source vibrates largely and is not fixed to the partition 110.

Further, the third writing stay 112-3 and the fourth writing stay 112-4 are fastened to the partition 110, so that mechanical rigidity of the entire housing frame 100 is enhanced (increased) when compared with the configuration in which not any writing stay 112 (i.e., the first writing stay 112-1, the second writing stay 112-2, the third writing stay 112-3, and the fourth writing stay 112-4) is fastened with the partition 110.

The configurations according to the above-descried embodiments are not limited thereto. This disclosure can achieve the following aspects effectively.

Aspect 1.

In Aspect 1, an image forming apparatus (for example, the image forming apparatus 1000) includes an image bearer (for example, the photoconductors 41Y, 41M, 41C, and 41K), a writing device (for example, the writing units 20*a* and 20*b* and the writing stays 112-1, 112-2, 112-3, and 112-4), a partition (for example, the partition 110), and a plurality of side members (for example, the front side panel 113*a* and the rear side panel 113*b*). The image bearer is configured to bear an image. The writing device is configured to write the image on the image bearer. The partition is disposed between the image bearer and the writing device. The plurality of side members is disposed facing and spaced apart from each other at an interval in an axial direction of the image bearer. The writing device is fixed to the plurality of side members and being spaced apart from the partition.

As described in the embodiments above, the partition has a planar shape and described in the embodiment, the partition plate is plate-shaped, and is likely to vibrate easily in a direction perpendicular to the surface of the partition. The image forming apparatus is provided with a contact and separation member (for example, the bypass pickup roller 52) to contact and separate with respect to the recording sheet (for example, the recording sheet P). Due to impact generated when the contact and separation member contacts a counter member, vibration may occur in the direction perpendicular to the surface of the partition in the image forming apparatus. When this vibration is transmitted to the partition, the partition significantly vibrates in the direction perpendicular to the surface of the partition in the image forming apparatus.

In a known image forming apparatus, a writing device is fastened (fixed) to the partition. Therefore, as the partition vibrates in the direction perpendicular to the surface of the partition as described above, the writing device vibrates together with the partition, and therefore it was likely to generate an image unevenness in a specific cycle.

By contrast, in Aspect 1, the writing device is fastened (fixed) to the plurality of side members (for example, the front side panel 113*a* and the rear side panel 113*b*) which are separate members from the partition. As a result, the writing device is prevented from vibrating together with the partition. Further, since the writing device does not contact the partition, the vibration of the partition is restrained from transmitting to the writing device directly, and therefore the vibration of the writing device is prevented. Accordingly, the vibration of the writing device is preferably prevented, and therefore the image unevenness generated in the specific cycle is restrained reliably.

Aspect 2.

In Aspect 1, the plurality of side members are side panels (for example, the front side panel 113*a* and the rear side panel 113*b*).

According to this configuration, the front side panel 113*a* and the rear side panel 113*b* hardly vibrate in the direction perpendicular to the surface of the partition, and therefore the side panels are prevented from vibrating together with the partition. Since the writing device is fixed to the side plates, vibration of the writing device is restrained.

Aspect 3.

In Aspect 1 or Aspect 2, the writing device includes a writing unit (for example, the first writing unit 20*a* and the second writing unit 20*b*) and an attachment member (for example, the first writing stay 112-1, the second writing stay 112-2, the third writing stay 112-3, and the fourth writing stay 112-4). The writing unit is configured to write the image on the image bearer. The attachment member is configured to attach the writing unit.

According to this configuration, the writing unit is less likely to vibrate by attaching the writing unit to the attachment member. Accordingly, the vibration of the writing device is preferably restrained, and therefore the image unevenness generated in the specific cycle is restrained reliably.

Aspect 4.

In Aspect 3, the attachment member (for example, the first writing stay 112-1, the second writing stay 112-2, the third writing stay 112-3, and the fourth writing stay 112-4) is fixed to the plurality of side members (for example, the front side panel 113*a* and the rear side panel 113*b*) and be spaced apart from the partition (for example, the partition 110).

According to this configuration, the attachment member is prevented from vibrating together with the partition. Further, the attachment member does not contact the partition, the vibration of the partition 110 is restrained from directly transmitting to the attachment member, and therefore the vibration of the attachment member is prevented. Accordingly, the vibration of the writing unit (for example, the first writing unit 20*a* and the second writing unit 20*b*) attached to the attachment member is preferably restrained, and therefore the image unevenness generated in the specific cycle is restrained reliably.

Aspect 5.

In Aspect 3 or Aspect 4, the writing unit (for example, the first writing unit 20*a* and the second writing unit 20*b*) is disposed in contact with only the attachment member (for example, the first writing stay 112-1, the second writing stay 112-2, the third According to this configuration, vibration is transmitted from the attachment member whose vibration is restrained, and therefore the vibration of the writing unit is prevented reliably.

Aspect 6.

In any one of Aspects 3 to 5, the flexural rigidity of the attachment member (for example, the first writing stay 112-1, the second writing stay 112-2, the third writing stay 112-3, and the fourth writing stay 112-4) is greater than the flexural rigidity of the partition (for example, the partition 110).

According to this configuration, the attachment member is less likely to vibrate than the partition 110, and therefore the vibration of the writing unit (for example, the first writing unit 20*a* and the second writing unit 20*b*) is restrained.

Aspect 7.

In Aspect 6, the attachment member (for example, the first writing stay 112-1, the second writing stay 112-2, the third writing stay 112-3, and the fourth writing stay 112-4) has a polygonal cross-sectional shape. (In the present embodiment, the attachment member has an arch shape.)

According to this configuration, as described in the embodiments above, the rigidity of the attachment member is greater than the rigidity of the partition (for example, the partition 110) having a planar shape.

Aspect 8.

In any one of Aspects 3 to 7, the attachment member (for example, the first writing stay 112-1, the second writing stay 112-2, the third writing stay 112-3, and the fourth writing stay 112-4) has a contact portion (for example, the base 112*f*) to contact the writing unit (for example, the first writing unit 20*a* and the second writing unit 20*b*), and a contact face of the contact portion to contact the writing unit is flat.

According to this configuration, as described in the embodiments above, the writing unit is attached stably, and the vibration of the writing unit is restrained.

Aspect 9.

In any one of Aspects 3 to 8, the image forming apparatus further includes a beam member (for example, the first front and rear stay 111*a*, the second front and rear stay 111*b*, and the third front and rear stay 111*c*) fixed to the plurality of side members (for example, the front side panel 113*a* and the rear side panel 113*b*). The flexural rigidity of the beam member is greater than the flexural rigidity of the attachment member (for example, the first writing stay 112-1, the second writing stay 112-2, the third writing stay 112-3, and the fourth writing stay 112-4).

According to this configuration, as described in the embodiments above, the vibration of the side members (in other words, the pair of side panels) is restrained. Accordingly, the vibration of the attachment member that is fixed to the side members is restrained, and therefore the vibration of the writing device is restrained.

Aspect 10.

In Aspect 9, the moment of inertia of the beam member (for example, the first front and rear stay 111*a*, the second front and rear stay 111*b*, and the third front and rear stay 111*c*) is greater than the moment of inertia of the attachment member (for example, the first writing stay 112-1, the second writing stay 112-2, the third writing stay 112-3, and the fourth writing stay 112-4).

According to this configuration, as described in the embodiments above, the rigidity of the beam member is greater than the rigidity of the attachment member.

Aspect 11.

In Aspect 9 or Aspect 10, a Young's modulus of the beam member (for example, the first front and rear stay 111*a*, the second front and rear stay 111*b*, and the third front and rear stay 111*c*) is greater than a Young's modulus of the attachment member (for example, the first writing stay 112-1, the second writing stay 112-2, the third writing stay 112-3, and the fourth writing stay 112-4).

According to this configuration, as described in the embodiments above, the rigidity of the beam member is greater than the rigidity of the attachment member.

Aspect 12.

In any one of Aspects 9 to 11, the image forming apparatus (for example, the image forming apparatus 1000) further includes a plurality of beam members (for example, the first front and rear stay 111*a*, the second front and rear stay 111*b*, and the third front and rear stay 111*c*) including the beam member and being disposed in a direction parallel to the partition (for example, the partition 110) at given intervals.

According to this configuration, as described with reference to FIG. 17, the attachment member (for example, the first writing stay 112-1, the second writing stay 112-2, the third writing stay 112-3, and the fourth writing stay 112-4) is fastened (fixed) to the region where the vibration of the plurality of side members (for example, the front side panel 113*a* and the rear side panel 113*b*) is hardly transmitted, and the vibration of the attachment member is reduced. Thus, the vibration of a writing device (for example, the writing units 20*a* and 20*b* and the writing stays 112-1 to 112-4) supported by the attachment member is restrained.

Aspect 13.

In any one of Aspects 9 to 12, the beam member (for example, the first front and rear stay 111*a*, the second front and rear stay 111*b*, and the third front and rear stay 111*c*) is fixed to the partition (for example, the partition 110).

According to this configuration, the mechanical rigidity of the entire housing frame (for example, the housing frame 100) is increased.

Aspect 14.

In any one of Aspects 1 to 13, the image forming apparatus (for example, the image forming apparatus 1000) further includes a plurality of writing devices (for example, the writing units 20*a* and 20*b* and the writing stays 112-1, 112-2, 112-3, and 112-4) including the writing device. At least one writing device of the plurality of writing devices is fixed to the plurality of side members (for example, the front side panel 113*a* and the rear side panel 113*b*) and is spaced apart from the partition (for example, the partition 110). The plurality of writing devices except the at least one writing device is fixed to the plurality of side members and disposed in contact with the partition.

According to this configuration, the vibration of a specific writing device (that is, the at least one writing device) is restrained.

Aspect 15.

In Aspect 14, the at least one writing device of the plurality of writing devices (for example, the writing units 20*a* and 20*b* and the writing stays 112-1, 112-2, 112-3, and 112-4) is a writing device (for example, the second writing unit 20*b* in the present embodiment) disposed closest to a vibration source (for example, the bypass sheet feeding device 150 in the present embodiment).

According to this configuration, as described in the embodiments above, the vibration of the specific writing device (the second writing unit 20*b* in the present embodiment) is restrained.

The effects described in the embodiments of this disclosure are listed as most preferable effects derived from this disclosure, and therefore are not intended to limit to the embodiments of this disclosure.

The embodiments described above are presented as an example to implement this disclosure. The embodiments described above are not intended to limit the scope of the invention. These novel embodiments can be implemented in various other forms, and various omissions, replacements, or changes can be made without departing from the gist of the invention. These embodiments and their variations are included in the scope and gist of the invention, and are included in the scope of the invention recited in the claims and its equivalent.

Any one of the above-described operations may be performed in various other ways, for example, in an order different from the one described above.

What is claimed is:

1. An image forming apparatus comprising:

an image bearer configured to bear an image;

a writing device configured to write the image on the image bearer, the writing device including a writing unit and an attachment member, the writing unit configured to write the image on the image bearer, and the attachment member configured to attach the writing unit;

a partition between the image bearer and the writing device; and a plurality of side members facing and spaced apart from each other at an interval in an axial direction of the image bearer, wherein the writing device is fixed to the plurality of side members and is spaced apart from the partition, and a flexural rigidity of the attachment member is greater than a flexural rigidity of the partition.

2. The image forming apparatus according to claim 1, wherein the plurality of side members are side panels.

3. The image forming apparatus according to claim 1, wherein the writing unit is in contact with only the attachment member.

4. The image forming apparatus according to claim 1, wherein the attachment member has a contact portion to contact the writing unit, and wherein a contact face of the contact portion that contacts the writing unit is flat.

5. The image forming apparatus according to claim 1, wherein the attachment member has a polygonal cross-sectional shape.

6. An image forming apparatus comprising:

an image bearer configured to bear an image;

a writing device configured to write the image on the image bearer, the writing device including a writing unit and an attachment member, the writing unit configured to write the image on the image bearer, and the attachment member configured to attach the writing unit;

a partition between the image bearer and the writing device;

a plurality of side members facing and spaced apart from each other at an interval in an axial direction of the image bearer; and a beam member fixed to the plurality of side members, wherein the writing device is fixed to the plurality of side members and is spaced apart from the partition, and a flexural rigidity of the beam member is greater than a flexural rigidity of the attachment member.

7. The image forming apparatus according to claim 6, wherein a moment of inertia of the beam member is greater than a moment of inertia of the attachment member.

8. The image forming apparatus according to claim 6, wherein a Young's modulus of the beam member is greater than a Young's modulus of the attachment member.

9. The image forming apparatus according to claim 6, further comprising:

a plurality of beam members including the beam member in a direction parallel to the partition at given intervals.

10. The image forming apparatus according to claim 6, wherein the beam member is fixed to the partition.

11. An image forming apparatus comprising:

a plurality of image bearers configured to bear respective images;

a plurality of writing devices configured to write the respective images on respective ones of the plurality of image bearers;

a partition between the plurality of image bearers and the plurality of writing devices; and a plurality of side members facing and spaced apart from each other at an interval in an axial direction of the plurality of image bearers, wherein at least one of the plurality of writing devices is fixed to the plurality of side members and is spaced apart from the partition, and the plurality of writing devices except the at least one writing device is fixed to the plurality of side members and in contact with the partition.

12. The image forming apparatus according to claim 11, wherein the at least one writing device of the plurality of writing devices is a writing device closest to a vibration source.

* * * * *